US008360543B2

(12) United States Patent
Komatsu et al.

(10) Patent No.: US 8,360,543 B2
(45) Date of Patent: Jan. 29, 2013

(54) LIQUID EJECTING APPARATUS AND EJECTION INSPECTING METHOD

(75) Inventors: Shinya Komatsu, Nagano-ken (JP); Tomohiro Sayama, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 379 days.

(21) Appl. No.: 12/856,721

(22) Filed: Aug. 16, 2010

(65) Prior Publication Data

US 2011/0050775 A1 Mar. 3, 2011

(30) Foreign Application Priority Data

Aug. 31, 2009 (JP) ..... 2009-200298

(51) Int. Cl.
*B41J 29/38* (2006.01)

(52) U.S. Cl. ..... 347/14

(58) Field of Classification Search ..... 347/14
See application file for complete search history.

(56) References Cited

U.S. PATENT DOCUMENTS

| | | | | |
|---|---|---|---|---|
| 7,543,904 | B2 | 6/2009 | Izuo | |
| 2010/0060690 | A1 * | 3/2010 | Hosokawa et al. | 347/14 |
| 2012/0133700 | A1 * | 5/2012 | Komatsu | 347/19 |

FOREIGN PATENT DOCUMENTS

| | | |
|---|---|---|
| JP | 2007-152888 | 6/2007 |

* cited by examiner

*Primary Examiner* — Laura Martin

(57) ABSTRACT

A liquid ejecting apparatus including: (A) a nozzle that ejects a liquid; (B) a sensor that outputs a signal in accordance with a temperature change of the liquid; (C) a driving signal generation section that generates a driving signal for ejecting the liquid from the nozzle; (D) an inspection section that ejects the liquid of a first electrical potential; and (E) a controller that corrects the driving signal that is generated at the driving signal generation section in accordance with the liquid temperature.

6 Claims, 14 Drawing Sheets

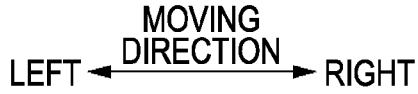
FIG. 3A
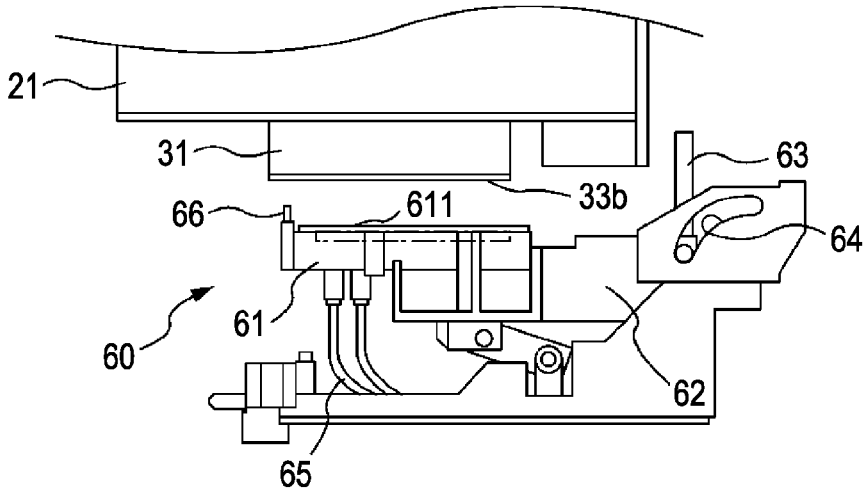
FIG. 3B
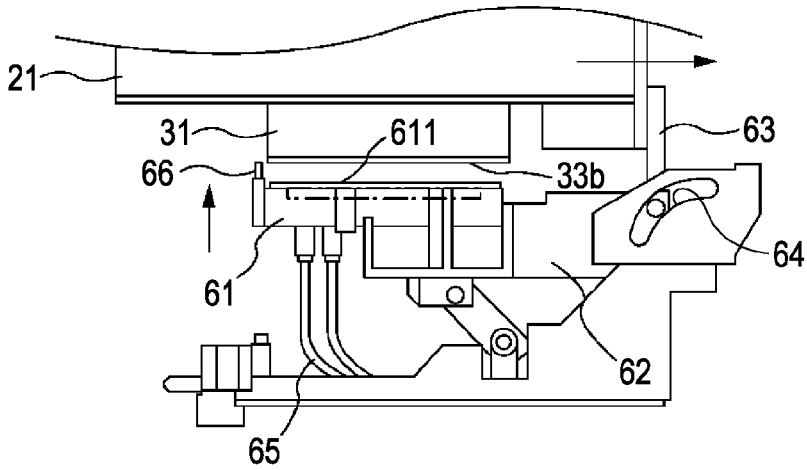
FIG. 3C
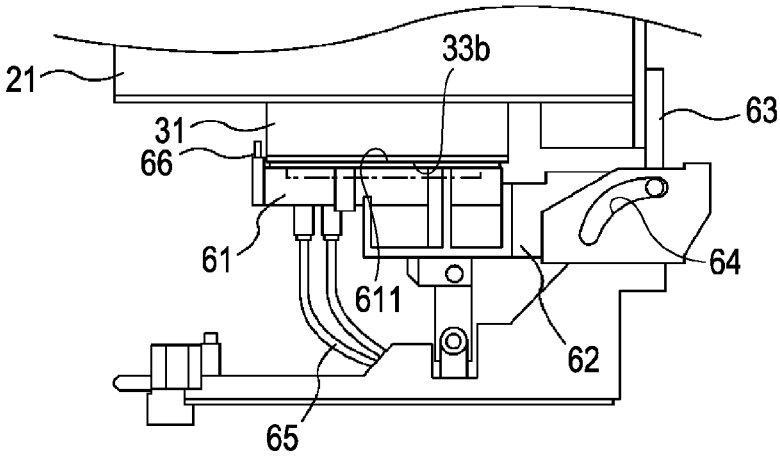

INK TEMPERATURE 40°C

INK TEMPERATURE 15°C

FIG. 11

| INK TEMPERATURE Ti (°C) | Vh CORRECTION AMOUNT |
|---|---|
| Ti ≥ 40 | + ΔVh1 |
| 40 > Ti ≥ 30 | + ΔVh2 |
| 30 > Ti ≥ 20 | ± 0 |
| 20 > Ti ≥ 10 | − ΔVh3 |
| 10 > Ti | − ΔVh4 |

LIQUID EJECTING APPARATUS AND EJECTION INSPECTING METHOD

CROSS-REFERENCE TO RELATED APPLICATION(S)

Japanese Patent Application No. 2009-200298, filed Aug. 31, 2009, is hereby incorporated by reference in its entirety.

BACKGROUND

1. Field of Invention

The present invention relates to a liquid ejecting apparatus and an ejection inspecting method.

2. Description of Related Art

In the liquid ejecting apparatus of an ink jet printer and the like, it has been suggested that the charged ink is ejected toward an electrode for inspecting, and the ejection inspecting of the liquid is performed on the basis of an electrical change at the electrode.

JP-A-2007-152888 is an example of related art.

In the above described ejection inspecting, a change of a distance between the electrode and the ink column projected from a nozzle is detected as an electrical change (a capacitance change). However, if the temperature of the ink ejected from the nozzle becomes high, the ink drop is separated easily from the ink column, and the distance between the electrode and the ink column changes become small. As a result, the detected electrical change is small as well, and there is a concern that a determination that the nozzle is clogged will be made even though ink drops are ejected from the nozzle.

SUMMARY OF INVENTION

An advantage of some aspects of the invention is that it provides an ejection inspecting method to perform inspection as accurately as possible.

According to an aspect of the invention, there is provided a liquid ejecting apparatus including: (A) a nozzle that ejects a liquid; (B) a sensor that outputs a signal in accordance with a temperature change of the liquid; (C) a driving signal generation section that generates a driving signal for ejecting the liquid from the nozzle; (D) an inspection section that ejects the liquid of a first electrical potential by the driving signal toward a second electrode of a second electrical potential which is different from the first electrical potential by making the liquid which is ejected from the nozzle to become the first electrical potential by a first electrode, and inspecting whether the liquid ejection from the nozzle is present or not on the basis of a capacitance change between the first electrode and the second electrode; and (E) a controller that corrects the driving signal that is generated at the driving signal generation section in accordance with the liquid temperature on the basis of an output result of the sensor when the ejection is inspected, and that makes a liquid weight of a first temperature more than a liquid weight of a second temperature, in which the liquid weight of the first temperature is ejected from the nozzle when the liquid temperature is the first temperature on the basis of an output result of the sensor and the liquid weight of the second temperature is ejected from the nozzle when the liquid temperature is the second temperature that is lower than the first temperature on the basis of the output result of the sensor.

Other features of the invention are clear from the description of the specification and accompanying drawings.

Other objects and attainments together with a fuller understanding of the invention will become apparent and appreciated by referring to the following description and claims taken in conjunction with the accompanying drawings.

BRIEF DESCRIPTION OF THE DRAWINGS

The invention will be described with reference to the accompanying drawings, wherein like numbers reference like elements.

FIG. 3A to FIG. 3C are drawings showing the positional relation between the head and a cap device.

FIG. 11 is a table showing the correction value corresponding to the ink temperature and the correction amount of maximum potential.

DESCRIPTION OF THE PREFERRED EMBODIMENTS

Figure 1A:
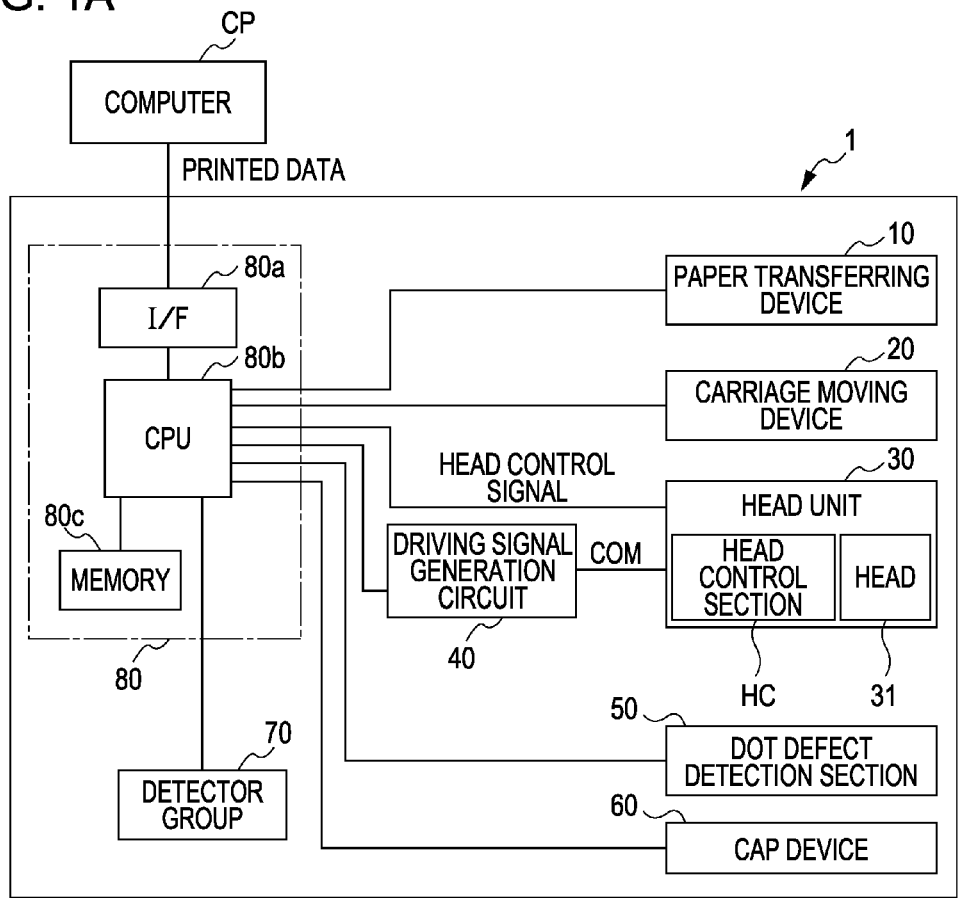
FIG. 1A is a block diagram illustrating a printing system.

The below description will be clear from the description of the specification and the description of the accompanying drawings.

According to an aspect of the invention, there is provided a liquid ejecting apparatus including: (A) a nozzle that ejects a liquid; (B) a sensor that outputs a signal in accordance with a temperature change of the liquid; (C) a driving signal generation section that generates a driving signal for ejecting the liquid from the nozzle; (D) an inspection section that ejects the liquid of a first electrical potential by the driving signal toward a second electrode of a second electrical potential which is different from the first electrical potential by making the liquid which is ejected from the nozzle to become the first electrical potential by a first electrode, and inspecting whether the liquid ejection from the nozzle is present or not on the basis of a capacitance change between the first electrode and the second electrode; and (E) a controller that corrects the driving signal that is generated at the driving signal generation section in accordance with the liquid temperature on the basis of an output result of the sensor when the ejection is inspected, and that makes a liquid weight of a first temperature more than a liquid weight of a second temperature, in which the liquid weight of the first temperature is ejected from the nozzle when the liquid temperature is the first temperature on the basis of an output result of the sensor and the liquid weight of the second temperature is ejected from the nozzle when the liquid temperature is the second temperature that is lower than the first temperature on the basis of the output result of the sensor.

According to the aspect of the invention, the ejection inspecting may be performed as accurately as possible, and the ejection inspecting time may be as short as possible.

In the ejecting apparatus, the inspection section inspects whether the liquid ejection from the nozzle is present or not, on the basis of the capacitance change that is changed in accordance with a distance from a tip end portion of the liquid column to the second electrode by the driving signal, and the liquid column is projected from the nozzle.

According to the aspect of the invention, regardless of liquid temperatures, the distance from the tip end portion of the liquid column to the second electrode may be as constant as possible, the ejection inspecting may be performed as accurately as possible, and the ejection inspecting time may be as short as possible.

In the ejecting apparatus, the apparatus classifies the liquid temperature that is detected by the sensor into a plurality of temperature ranges, and a correction amount is set with respect to the driving signal in each temperature range, and the controller does not correct the driving signal that is generated at the driving signal generation section, when the liquid temperature belongs to the temperature range including room temperature, on the basis of the output result of the sensor.

According to the aspect of the invention, it may be prevented that the distance from tip end portion of the liquid column to the second electrode is too long or too short.

In the ejecting apparatus, the driving signal repeatedly generates a driving waveform for ejecting the liquid from the nozzle, and a gap is constant between the driving waveform inspecting whether the liquid ejection from one of the nozzles is present or not and the driving waveform inspecting whether the liquid ejection from the next nozzle is present or not.

According to the aspect of the invention, the control of the ejection inspecting may be performed easily.

In the ejecting apparatus, the driving waveform that is generated at the driving signal is applied so as to drive a driving element, and a pressure chamber that communicates with the nozzle corresponding to the driving element is expanded or contracted so as to eject the liquid from the nozzle, the driving waveform has an expansion component and a contraction component, in which the expansion component expands the pressure chamber due to the electrical potential change from a predetermined electrical potential to the first electrical potential, and the contraction component contracts the expanded pressure chamber due to the electrical potential change from the first electrical potential to the second electrical potential, and the controller corrects the first electrical potential of the driving waveform that is generated at the driving signal generation section in accordance with the liquid temperature on the basis of the output result of the sensor.

According to the aspect of the invention, the liquid weight that is ejected from the nozzle may be adjusted in accordance with the liquid temperature.

According to another aspect of the invention, there is provided an ejection inspecting method that ejects the liquid of a first electrical potential by a driving signal toward a second electrode of a second electrical potential which is different from the first electrical potential by making the liquid that is ejected from a nozzle to become the first electrical potential by a first electrode, and inspecting whether the liquid ejection from the nozzle is present or not on the basis of a capacitance change between the first electrode and the second electrode, the method comprising: correcting the driving signal corresponding to the liquid temperature on the basis of an output result of a sensor that outputs a signal corresponding to the change of the liquid temperature; and making a liquid weight of a first temperature more than a liquid weight of a second temperature, the liquid weight of the first temperature is ejected from the nozzle when the liquid temperature is the first temperature on the basis of an output result of the sensor and the liquid weight of the second temperature is ejected from the nozzle when the liquid temperature is the second temperature that is lower than the first temperature on the basis of the output result of the sensor.

According to the aspect of the invention, the ejection inspecting may be performed as accurately as possible, and the ejection inspecting time may be as short as possible.

Ink Jet Printer

An embodiment of an ink jet printer (referred to as the printer 1, herein below) will be described in detail as a liquid ejecting apparatus.

Figure 1B:
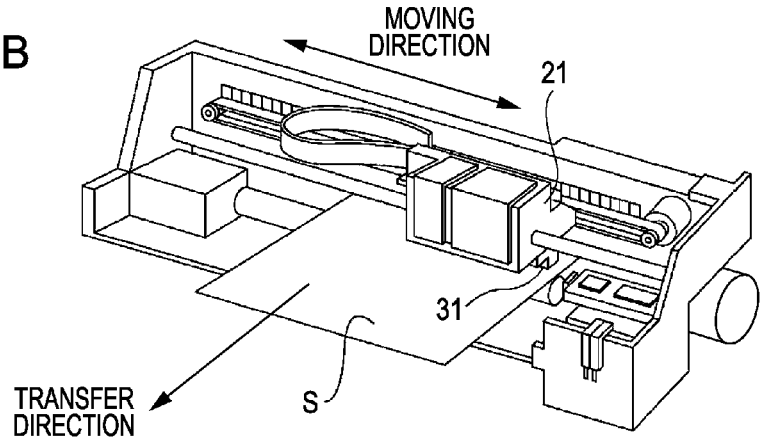
FIG. 1B is a perspective view of the printer.

FIG. 1A is a block diagram illustrating a printing system having the printer 1 and a computer CP. FIG. 1B is a perspective view of a printer 1. The printer 1 ejects the ink that is a kind of liquid to the transfer material such as paper, cloth, film and the like. The computer CP is connected communicably to the printer 1. The computer CP transfers print data to the printer 1 for printing an image to the printer 1 in accordance with the image. The printer 1 has a paper transfer device 10, a carriage moving device 20, a head unit 30, a driving signal generation circuit 40, a dot defect detector 50, a cap device 60, a detector group 70, and a controller 80.

The paper transfer device 10 transfers the paper toward the transfer direction. The carriage moving device 20 moves the carriage 21 to which the head unit 30 is attached toward the moving direction (crossing direction to the transfer direction).

The head unit 30 has a head 31 and a head controller HC. The head 31 ejects the ink toward the paper. The head controller HC controls the head 31 on the basis of the head control signal from the controller 80 of the printer 1.

Figure 2A:
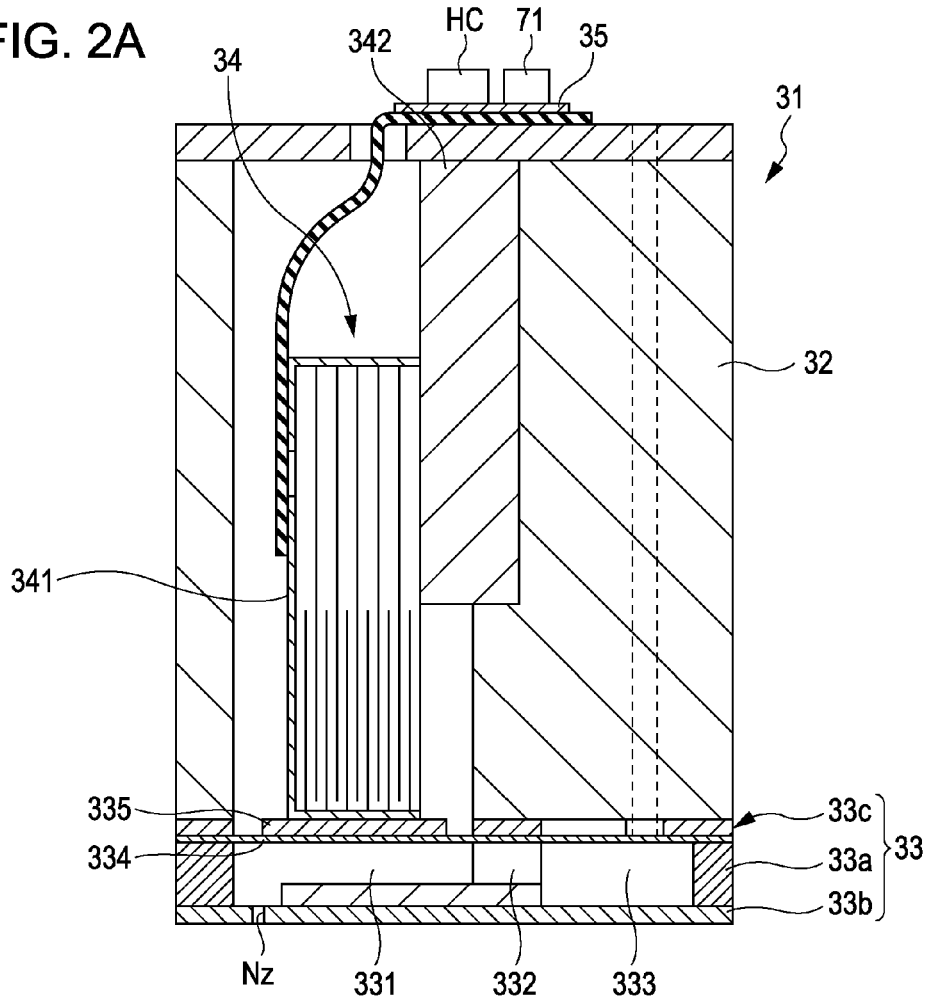
FIG. 2A is a cross sectional view of a print head.

FIG. 2A is a cross sectional view of the head 31. The head 31 has a case 32, a flow path unit 33 and piezoelectric element unit 34. The case 32 is a member that receives and fixes piezoelectric element PZT, and the like, and made by non-conductive resin such as epoxy resin, for example.

The flow path unit 33 has a flow path forming substrate 33*a*, a nozzle plate 33*b* and a vibration plate 33*c*. The nozzle plate 33*b* is attached to the one surface of the flow path forming substrate 33*a* and the vibration plate 33*c* is attached the other surface of the flow path forming substrate 33*a*. The flow path forming substrate 33*a* has a space section or a groove including a pressure chamber 331, an ink supply path 332 and a common ink chamber 333. The flow path forming substrate 33*a* is made by a silicon substrate, for example. The nozzle plate 33*b* is provided with a nozzle group including a plurality of nozzles Nz. The nozzle plate 33*b* is made by plate shaped member having conductive material, made by a sheet metal plate, for example. Also, the nozzle plate 33*b* is ground potential connected with the ground line. A portion of the vibration plate 33*c* corresponding to each pressure chamber 331 provides a diaphragm section 334. The diaphragm section 334 is deformed by piezoelectric element PZT, and changes the volume of the pressure chamber 331. Also, the piezoelectric element PZT and the nozzle plate 33*b* are in an electrically insulated state due to be the vibration plate 33*c* or adhesive layer interposed there between.

The piezoelectric element unit 34 has a piezoelectric element group 341 and a fixing plate 342. The piezoelectric element group 341 has a pectinate shape. Thus, each tooth of the comb is a piezoelectric element PZT. A tip end portion of each piezoelectric element PZT adheres to an island section 335 which is composed of the corresponding diaphragm section 334. The fixing plate 342 maintains the piezoelectric element group 341 and is an attachment section to the case 32. The piezoelectric element PZT is a kind of electro-mechanical converting element, is expanded or contracted in the longitudinal direction, and changes the liquid pressure within the pressure chamber 331 when the driving signal COM is applied. The pressure of the ink within the pressure chamber 331 is changed due to the volume change of the pressure chamber 331. The ink droplets may be ejected from the nozzle Nz using the pressure change.

Figure 2B:
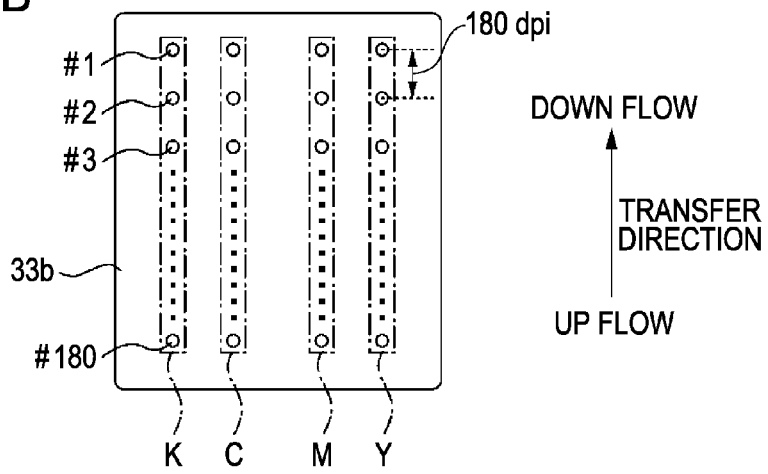
FIG. 2B is a drawing showing an arrangement of the nozzles.

FIG. 2B is a drawing showing an arrangement of the nozzles Nz that is provided on the nozzle plate 33*b*. 180 nozzles (#1 to #180) are provided on the nozzle plate such that a plurality of nozzles positioned in line with the nozzle row in a gap of 180 dpi along the transfer direction of the paper. Each nozzle row ejects a different color ink respectively, and the nozzle plate 33*b* provides 4 nozzle rows. Specifically, they include a black ink nozzle row K, a cyan ink nozzle row C, a magenta ink nozzle row M and a yellow ink nozzle row Y.

The driving signal generation circuit 40 (corresponding to the driving signal generation section) generates a driving signal COM. When the driving signal COM is applied to the piezoelectric element PZT, the piezoelectric element is contracted or expanded, and the volume of the pressure chamber 331 corresponding to each nozzle Nz changes. Thus, the driving signal COM is applied to the head 31 in printing, or in inspecting the dot defect (described herein below), and in the brushing that is the recovery operation of the dot defect nozzle Nz.

A dot defect detection section 50 (corresponding to the inspection section) detects whether or not the ink is ejected from each nozzle Nz. The cap device 60 suppresses the evaporation of the ink solvent from the nozzle Nz, or performs a suction operation that sucks the ink from each nozzle Nz to recover the ejection capacity of the nozzle Nz. The detection device group 70 includes a plurality of the detection devices that monitors a status of the printer 1. The detection result by the detection device is output to the controller 80.

The controller 80 (corresponding to the control section) performs over-all controls of the printer 1, and includes an interface section 80*a*, CPU 80*b* and a memory 80*c*. The interface section 80*a* performs data receiving or transmitting with the computer CP. The memory 80*c* secures an area for receiving a computer program or an area for working. CPU 80*b* controls each control objects section (the paper transferring device 10, the carriage moving device 20, the head unit 30, the driving signal generation circuit 40, the dot defect detection section 50, the cap device 60 and the detection device group 70) in accordance with the computer program stored in the memory 80*c*.

The ink is ejected from the head 31 that moves along the moving direction of the carriage in the printer 1 and repeatedly performs a dot forming process that forms a dot on the paper and a transferring process that transfers the paper to the transferring direction. As a result, the dot forms on another position that is different from the dot position formed by the above mentioned dot forming process and two-dimensional image is printed on the medium.

Ejection Inspecting Summary and Recovery Operation

When the ink (liquid) has not been ejected for a long time, or foreign materials such as paper dust have become attached to the nozzle, the nozzle is clogged. If the nozzle is clogged, the ink is not ejected at the time that the ink should be ejected from the nozzle, and the dot is not formed in a position where the dot should be placed (the dot defect). When the "dot defect" occurs, the image quality becomes downgraded. Thus, in the case that a dot defect nozzle is detected as a result of the dot defect detection section 50 performing the "ejection inspection", a "recovery operation" is performed so the ink is ejected normally from the nozzle.

Also, it is preferable that the dot defect inspection is performed just after the power supply of the printer 1 is ON, or when the printer 1 receives the printing data from the computer CP to start printing. In addition, the dot defect inspection may also be carried out during long duration printing in predetermined time intervals. Herein below the description will be made regarding the ejection inspecting summary, after description regarding the recovery operation of the dot defect nozzle.

Recovery Operation

FIG. 3A to FIG. 3C are drawings showing the positional relation between the head 31 and the cap device 60 in the recovery operation. First of all, description will be made regarding the cap device 60. The cap device 60 includes a cap 61 and a slider member 62 that supports the cap 61 and can move in an inclined up and down direction. The cap 61 that has a sheet box shape including a rectangular base section (not shown in the drawings) and a side wall section 611 that stands up-right from the periphery of the base section, and the top surface of the cap 61 opens to face the nozzle plate 33*b*. A space that is surrounded by the base section and the side wall section 611 arranges a sheet shape moisture member made by porous material such as felt or sponge.

As shown in FIG. 3A, the cap 61 is located sufficiently lower than the surface of the nozzle plate 33*b* (referred to as the nozzle surface, herein below) in the state that the carriage 21 is out of the home position (here, at the right side of the moving direction). Thus, as shown in FIG. 3B, when the carriage 21 moves to the home position, the carriage 21 contacts the contact section 63 provided on the slider member 62, and the contact section 63 moves to the home position with the carriage 21. When the contact section 63 moves to the home position, the slider member 62 rises along a long hole 64 for guiding, thus the cap 61 rises as well. Finally, as shown in FIG. 3C, when the carriage 21 is located in the home position, the side wall section 611 (the porous material) of the cap 61 and the nozzle plate 33*b* closely contacts each other. Thus, when the power supply is OFF or when the operation stops for a long time, the carriage 21 is located in the home position, so as to suppress the evaporation of the ink medium from the nozzle.

Next, the description will be made regarding the recovery operation. One of the recovery operations of the dot defect nozzles is a "brushing operation". As shown in FIG. 3B, in the state that a small gap is present between the nozzle surface and the periphery of the opening of the cap 61, the brushing operation ejects the ink droplets continuously and forcedly from each nozzle, so as to rectify the clogging of the nozzle.

Also, a waste liquid tube 65 is connected to the space surrounded by the base surface of the cap 61 and the side wall section 611, and a suction pump (not shown in the drawings) is connected to the middle of the waste liquid tube 65. As one of other recovery operations, "pump suction" is performed, in the state that the periphery of the opening of the cap 61 contacts the nozzle surface, as shown in FIG. 3C. The space of the cap 61 may have a negative pressure when the suction pump is operated in the state that the side wall section 611 of the cap 61 contact the nozzle surface closely. Thus, the ink within the head 31 can suck up with thickened ink or the paper dust, and the dot defect nozzle can be recovered.

For the rest, the cap device 60 is maintained in the position shown in FIG. 3B, while the carriage 21 is moved in the moving direction, so that the ink droplets that are attached on the nozzle surface or foreign materials are removed by the wiper 66 which is projected upwardly higher than the side wall section 611 of the cap 61. As a result, the ink may be ejected normally from the nozzle clogged by the foreign materials.

Dot Defect Detection Section 50

Figure 4:
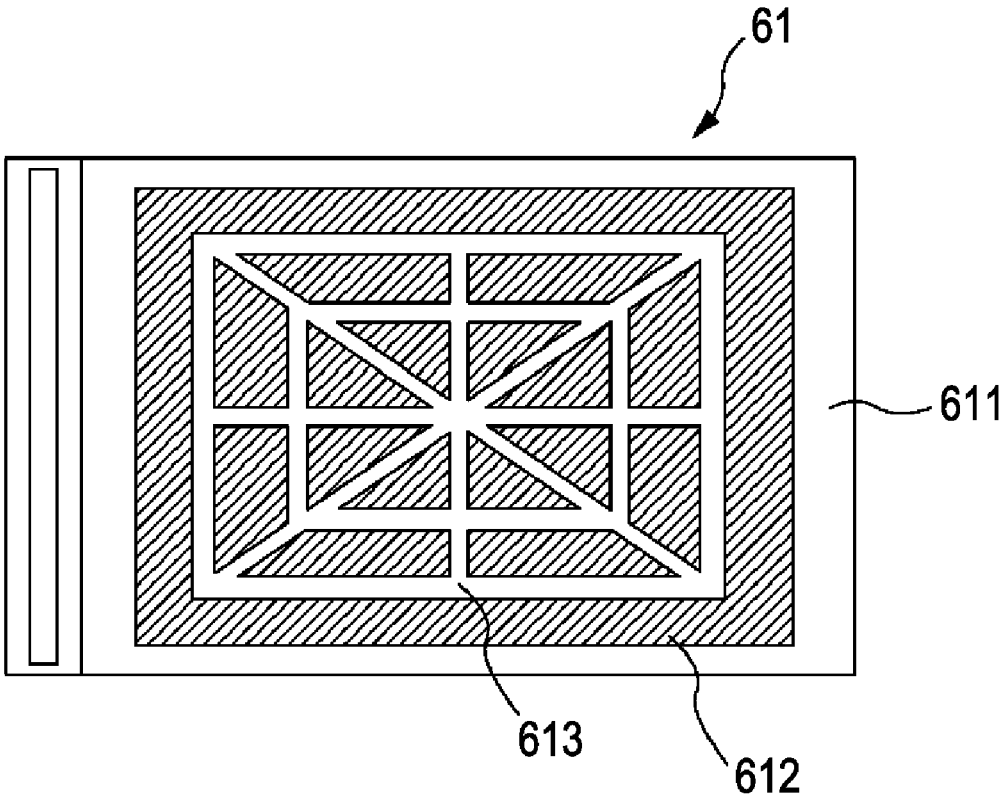
FIG. 4 is a top view showing the cap from above.
Figure 5A:
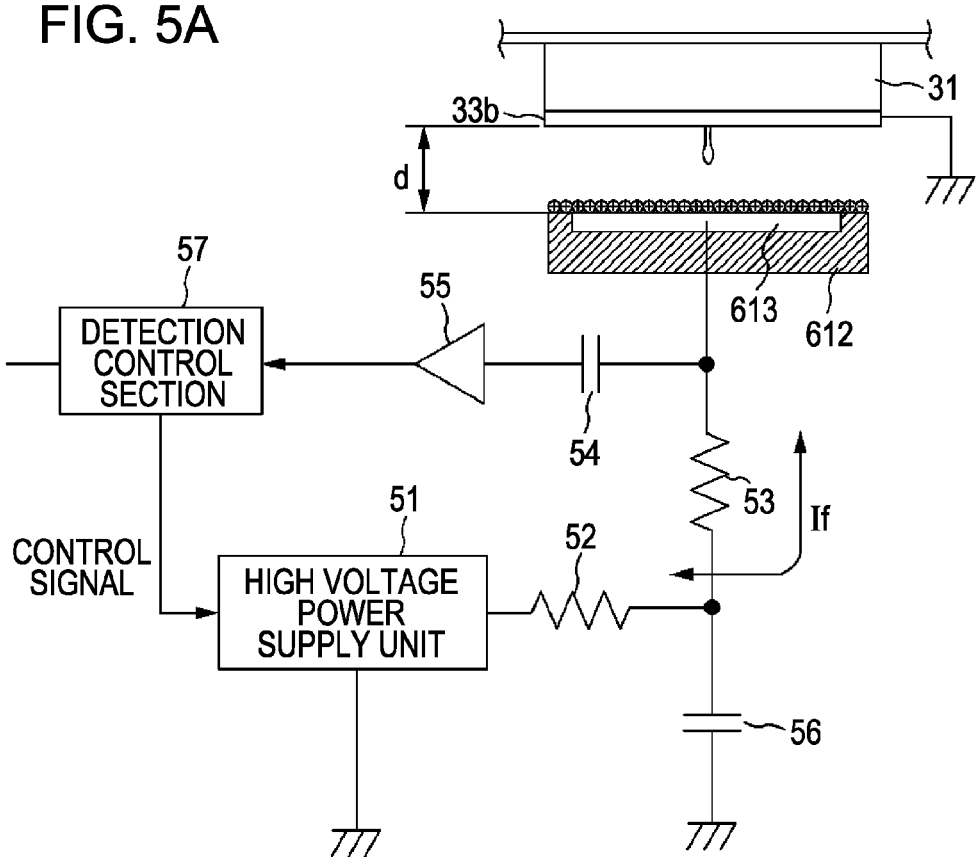
FIG. 5A is a view illustrating a dot defect detection section.
Figure 5B:
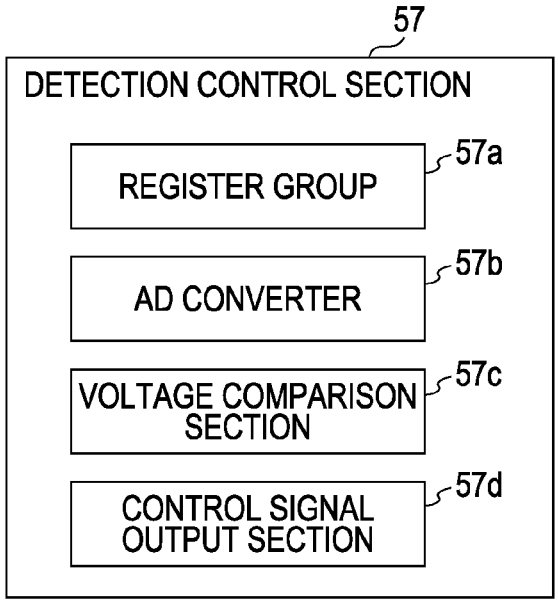
FIG. 5B is a block diagram illustrating a detection control section.

FIG. 4 is a top view showing the cap 61 from above, FIG. 5A is a view illustrating a dot defect detection section 50, and FIG. 5B is a block diagram illustrating a detection control section 57. The dot defect detection section 50 detects the dot defect nozzle in accordance with whether or not the ink is ejected substantially and normally from each nozzle. First of all, description will be made regarding the constitution of the dot defect detection section 50. As shown in FIG. 5A, the dot defect detection section 50 includes a high voltage source unit 51, a first limit resistance 52, a second limit resistance 53, a condenser for detection 54, an amplifier 55, a smoothing condenser 56 and a detection control section 57.

As shown in FIG. 3B and FIG. 5A, the nozzle surface faces to the cap 61 with a predetermined gap d. As shown in FIG. 4, a moisture member 612, and a wire shaped electrode for detection 613 are arranged in the space that is surrounded with the side wall section 611 of the cap 61. The electrode for detection 613 reaches a high potential of about 600V to 1 kV, when the dot defect detection is performed. The electrode for detection 613, as shown in FIG. 4, has a frame section that is provided with a double rectangular shape, a diagonal section that connects between the opposite angles of the frame section, and a cross section that connects between center points of the each side of the frame section. In accordance with the constitution, constant electric charge is accomplished through wide ranges. Also, the ink solvent of this embodiment is a conductive liquid (water, for example) and when the electrode for detection 613 reaches a high potential in the state that the moisture member 612 is moist, the surface of the moisture member 612 reaches the same potential. Regarding this point as well, the area that the ink is ejected from nozzle is constantly charged over wide ranges.

The high voltage power supply unit 51 is a kind of power supply in which the electrode for detection 613 within the cap 61 is at a predetermined potential. The high voltage power supply unit 51 of the embodiment constitutes direct current power supply of about 600V to 1 kV, and controls the operation in accordance with the control signal from the detection control section 57.

The first limit resistance 52 and the second limit resistance 53 are arranged between the output terminal of the high voltage power supply unit 51 and the electrode for detection 613, and restrict the current that flows between the high voltage power supply unit 51 and the electrode for detection 613. In the embodiment, the first limit resistance 52 and the second limit resistance 53 have the same resistance value (1.6 MΩ, for example), and the first limit resistance 52 and the second limit resistance 53 are connected in serial. As shown in the drawings, one end of the first limit resistance 52 is connected to the output terminal of the high voltage power supply unit 51, the other end is connected to one end of the second limit resistance 53, and the other end of the second limit resistance 53 is connected the electrode for detection 613.

The condenser for detection 54 is an element for extracting the potential change component of the electrode for detection 613, the conductor of one side is connected to the electrode for detection 613, and the conductor of the other side is connected to the amplifier 55. The condenser for detection 54 is interposed there between, so as to cancel a bias component of the electrode for detection 613 (serial component), and the signal may be easily handled. In the embodiment, the capacity of the condenser for detection 54 becomes 4700 pF.

The amplifier 55 amplifies and outputs the signal (potential change) that is present on the other end of the condenser for detection 54. The amplifier 55 of the embodiment has an amplification rate of 4000 times. Thus, the change component of the potential may be acquired as the voltage signal having a change range of about 2 to 3V. The set of the condenser for detection 54 and amplifier 55 forms a kind of detection section, and detects electrical change generated in the electrode for detection 613, which is caused by the ejection of the ink droplet.

The smoothing condenser 56 restricts a sudden change of the potential. The smoothing condenser 56 of the embodiment is connected to the signal line of which one end connects the first limit resistance 52 and the second limit resistance 53, and the other end of which is connected to the ground. Thus, the capacity is 0.1 μF.

The detection control section 57 is a part to control the dot defect detection section 50. As shown in FIG. 5B, the detection control section 57 has a resister group 57*a*, an AD converter 57*b*, a voltage comparison section 57*c*, and a control signal output section 57*d*. The resister group 57*a* is composed of a plurality of registers. Each register stores a determination result for each nozzle Nz or the voltage threshold value for determination. The AD converter 57*b* converts the voltage signal (analogue value) to the digital value after amplification that is outputted from the amplifier 55. The voltage comparison section 57*c* compares the size of the amplitude value with the voltage threshold value on the basis of the voltage signal after amplification. The control signal output section 57*d* outputs the control signal for controlling the operation of the high voltage power supply unit 51.

Summary of the Ejection Inspecting

In the printer 1, the nozzle plate 33*b* (corresponding to the first electrode) is the ground potential (corresponding to the first potential) connected to the ground, and the electrode for detection 613 (corresponding the second electrode) that is located on the cap 61 reaches a high potential (corresponding to the second potential) of about 600V to 1 kV. The ink droplet ejected from the nozzle becomes the ground potential due to the nozzle plate of the ground potential. The nozzle plate 33*b* and the electrode for detection 613 face each other with the predetermined gap d (referred to in FIG. 5A), so as to eject the ink droplet from the nozzle of the detection object. Thus, the detection control section 57 acquires the electrical change as the voltage signal SG that is caused by the ejection of the ink droplet, and that is generated at the side of the electrode for detection 613 through the condenser for detection 54 and the amplifier 55. The detection control section 57 determines whether or not the ink droplet is ejected normally from the nozzle of the detection object, on the basis of the amplitude value (the potential change) at the voltage signal SG.

The principle of the detection is not precisely explained, but it seems that those members acts like a condenser due to the nozzle plate 33*b* and the electrode for detection 613 which are positioned with a gap d there between. As shown in FIG. 5A, the ink contacts the nozzle plate 33*b* that is connected to the ground, so as to extend the column shaped ink (the ink column) extended to the nozzle Nz and the ink is in the ground potential. It seems that the extension of the ink changes the capacitance in the condenser. In other words, the ink is ejected from the nozzle, so that the ink of the ground potential and the electrode for detection 613 constitute the condenser, and the capacitance changes.

Thus, when the capacitance becomes small, the charge amount that is accumulated between the nozzle plate 33*b* and the electrode for detection 613 decreases. On account of this, the surplus charge moves to the side of the high voltage power supply unit 51 side through each limit resistance 52, 53 from the electrode for detection 613. In other words, the current flows to the high voltage power supply unit 51. Meanwhile, when the capacitance increases or decreases repeatedly, the charge moves to the side of the electrode for detection 613 through each limit resistance 52, 53 from the high voltage power supply unit 51. In other words, the current flows to the electrode for detection 613. When the current (for convenience, referred to as current If for ejection inspecting) flows, the potential of the electrode for detection 613 changes. The potential change of the electrode for detection 613 is present as the potential change of the other side of the conductor (the side of the conductor of the amplifier 55) in the condenser for detection 54 as well. Thus, the potential change of the other side of the conductor is monitored, so as to determine whether or not the ink droplet is ejected.

Figure 6A:
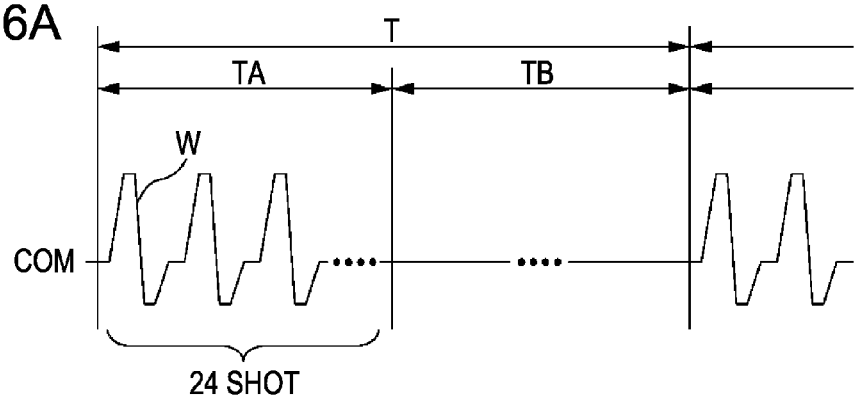
FIG. 6A is a view showing a driving signal.
Figure 6B:
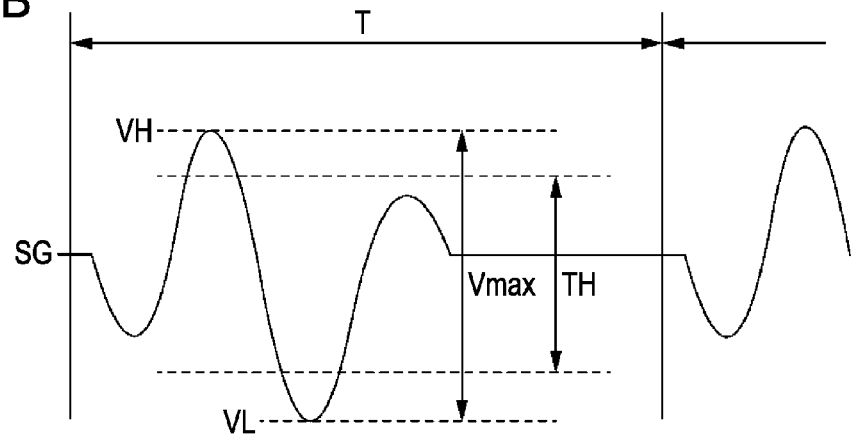
FIGS. 6B and 6C are views illustrating a voltage signal outputting from an amplifier.
Figure 6C:
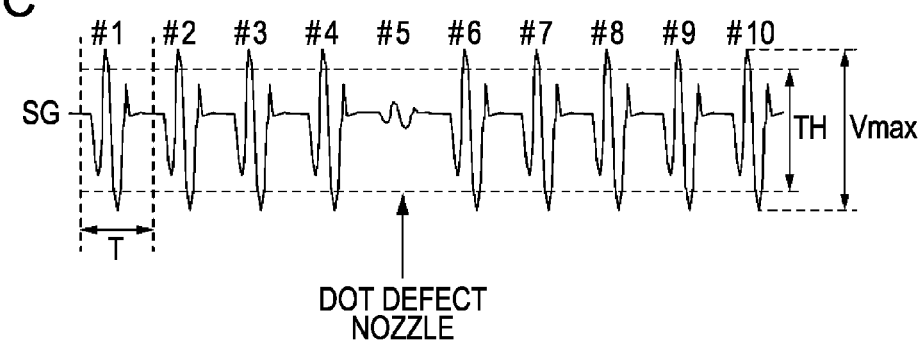

FIG. 6A is a view showing an example of the driving signal COM used in the ejection inspecting. FIG. 6B is a view illustrating a voltage signal SG that is outputted from an amplifier 55 in the case that the ink is ejected from the nozzle by the driving signal COM of FIG. 6A and FIG. 6C is a view illustrating a voltage signal SG that is an ejection inspecting result of a plurality of nozzles (#1 to #10). The driving signal COM has a plurality of driving waveforms W (for example, 24 waveforms) so as to eject repeatedly the ink from the nozzle in the first half TA of a repeat period T, and the potential is maintained constantly at the middle potential at the second half TB. The driving signal generation circuit 40 repeatedly generates a plurality of the driving waveform W (24 driving waveforms) for each repeat period T. The repeat period T corresponds to the time necessary for the inspection of a nozzle.

First of all, the driving signal COM is applied on the piezoelectric element corresponding to one of the nozzles of the inspection objects over the repeat period T. To do so, the ink droplet is ejected continuously from the nozzle of the ejection inspecting objects in the first half TA (24 shots hit, for example). Thus, the potential of the electrode for detection 613 changes, and the amplifier 55 outputs the potential change to the detection control section 57 as the voltage signal SG (sin curve) shown in FIG. 6B. Also, the amplitude of the voltage signal SG becomes small in accordance with the ink droplet for worthy of one shot, so as to eject the ink droplet continuously from the nozzle, and to acquire the voltage signal SG that has sufficient amplitude in the inspection.

The detection control section 57 outputs the maximum amplitude Vmax (difference between maximum potential VH and minimum voltage VL) from the voltage signal SG in the inspection period T of the nozzle of the inspection objects, and compares the maximum amplitude Vmax to the predetermined threshold value TH. When the ink is ejected from the nozzle of the inspection objects in accordance with the driving signal COM, the potential of the electrode for detection 613 changes, and the maximum amplitude Vmax of the voltage signal SG becomes larger than the threshold value TH. Meanwhile, when the ink is not ejected from the nozzle of the inspection objects, or the ink amount ejected from the nozzle becomes small due to clogging, the potential of the electrode for detection 613 changes or the potential change becomes small, so that the maximum amplitude Vmax of the voltage signal SG becomes lower than the threshold value TH.

After the driving signal COM has been applied to the piezoelectric element corresponding to a nozzle, the driving signal COM is applied to the piezoelectric element corresponding to the next nozzle of the inspection objects over the repeat period T, so that the driving signal COM is applied to the piezoelectric element corresponding to the nozzle for each nozzle of the inspection objects over the repeat period T. As a result, as shown in FIG. 6C, the voltage signal SG that generates potential change of the sin curve for each repeat period T is acquired by the detection control section 57.

For example, in the result of in FIG. 6C, the maximum amplitude Vmax of the voltage signal SG corresponding to the inspection period of nozzle #5 is lower than the threshold value TH, so that the detection control section 57 determines that the nozzle #5 is the dot defect nozzle. The maximum amplitude Vmax of the voltage signal SG corresponding to each inspection period of other nozzles (#1 to #4 and #6 to #10) is not less than the threshold value TH, so that the detection control section 57 determines that the other nozzles are normal nozzles. Thus, in the case that a dot defect nozzle is detected by the dot defect detection section 50, the controller 80 of the printer 1 performs the recovery operation regarding the head 31. As a result, a high quality image can be printed without the dot defect.

Ejection Inspecting of the Embodiment Regarding Leaving Trace Amount

Figure 7A:
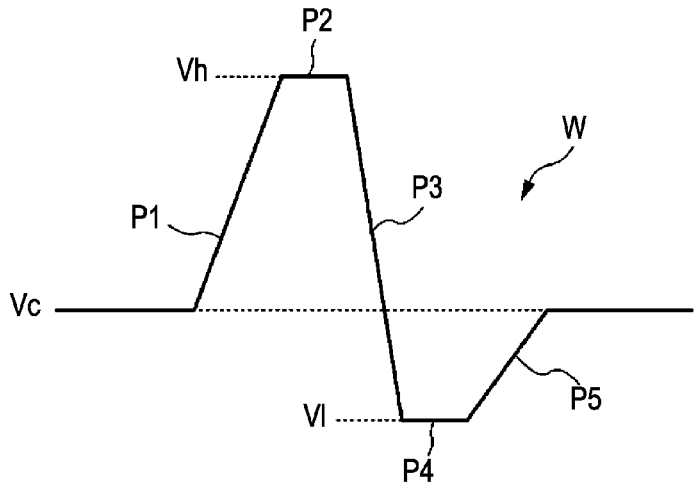
FIG. 7A is a view showing a driving waveform.
Figure 7B:
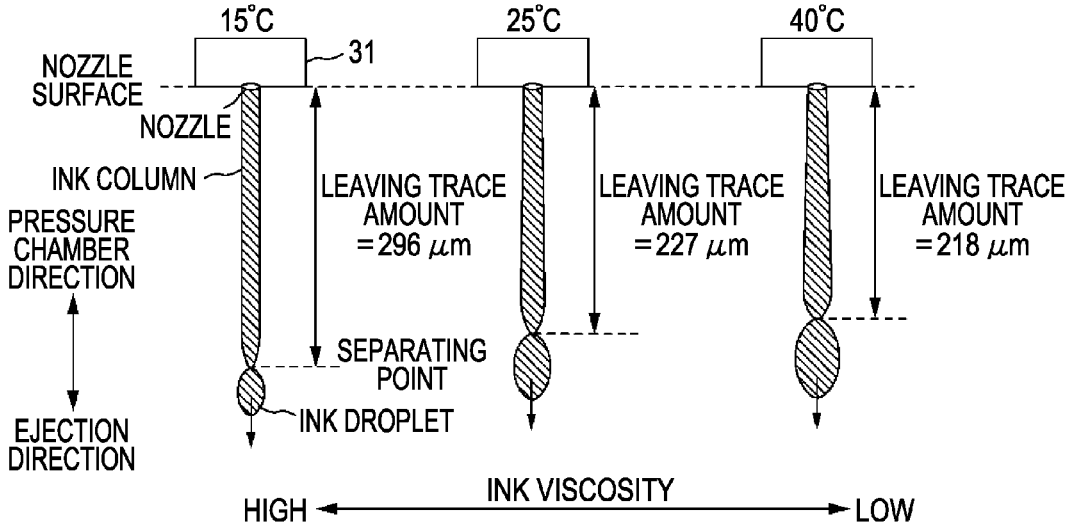
FIG. 7B is a view showing different lengths of leaving traces due to different ink temperatures.

FIG. 7A is a view showing a driving waveform W that is generated in the driving signal COM (FIG. 6A) for inspection, and FIG. 7B is a view showing different lengths of leaving traces due to different ink temperatures. FIG. 7B shows that the ink is projected with a column shape from the nozzle provided on the head 31, and the inclined section in the drawing corresponds to the ink.

First of all, detailed description will be made regarding the driving waveform W generated at the driving signal COM for inspection. The driving waveform W includes a first expansion component P1 in which the potential rises from the middle potential Vc (the predetermined potential) to the maximum potential Vh (the first potential), a first hold component P2 that maintains maximum potential Vh, a contraction component P3 in which the potential drops from the maximum potential Vh to the minimum potential V1, a second hold component P4 in which maintains the minimum potential V1 (the second potential), and a second expansion component P5 that the potential rises from the minimum potential V1 to the middle potential Vc.

The piezoelectric element is not contracted or expanded, in the state that the middle potential Vc is applied to the piezoelectric element (PZT in FIG. 2A), the volume of the pressure chamber (331 in FIG. 2A) becomes the reference volume when the middle potential Vc is applied to the piezoelectric element. When the first expansion component P1 of the driving waveform W is applied to the piezoelectric element, the piezoelectric element contracts in the longitudinal direction, and the volume of the pressure chamber expands. Thus, when the first hold component P2 is applied to the piezoelectric element, contraction of the piezoelectric element is maintained, thus the expansion of the pressure chamber is maintained, as well. Next, when the contraction component P3 is applied to the piezoelectric element, the piezoelectric element expands at once from the contracted state and the volume of the pressure chamber contracts at once. Due to the contraction of the pressure chamber, the ink pressure of the pressure chamber rises rapidly, the ink column is projected from the nozzle, and the ink droplet is scattered in the ejection direction. After that, the second hold component P4 is applied to the piezoelectric element, and the expansion state of the potential element and the expansion of the pressure chamber are maintained. Finally, when the second expansion component P5 is applied to the piezoelectric element, the volume of the pressure chamber returns to the reference volume.

As shown in FIG. 7B, when the pressure chamber is contracted by the contraction component P3 of the driving waveform W, the ink is in the projected state as a column shape. After that, the tip end portion of the ink column is separated from the ink column, and is scattered in the ejection direction. The tip end portion of the ink column is referred to as the "main droplet". In printing, the main droplet that is separated from the ink column elastically attaches to the medium, so as to form the dot. Meanwhile, after the tip end portion (main droplet) is separated, the remaining ink column forms small ink droplet (satellite) or returns to the pressure chamber. For the below description, as shown in FIG. 7B, the distance between the nozzle surface and a position at which the tip end portion of the ink column (main droplet) that is projected from the nozzle by the contraction component P3 of the driving waveform W is separated is referred to as the "leaving trace amount".

FIG. 7B is a measurement result of the leaving trace amounts when the ink is ejected from the nozzle by the same driving waveform W while making several changes to the ink temperatures (15° C., 25° C., and 40° C.). The leaving trace amount becomes 296 μm when the ink temperature is 15° C., the leaving trace amount becomes 227 μm when the ink temperature is 25° C., and the leaving trace amount becomes 218 μm when the ink temperature is 40° C. It may be understood that when the ink is ejected from the nozzle with the same driving waveform W, the leaving trace amount becomes long as the ink temperature decreases, and the leaving trace amount becomes short as the ink temperature increases. In other words, as the ink temperature increases, the viscosity of the ink is lowered, the tip end portion of the ink column is separated easily, and the leaving trace amount becomes short, conversely as the ink temperature decreases, the viscosity of the ink is raised, the tip end portion of the ink column is separated with difficulty, and the leaving trace amount becomes long.

However, in the ejection inspecting of the embodiment (FIG. 5A), the nozzle plate 33*b* of the ground potential and the electrode for detection 613 of the high potential are arranged with a predetermined gap d and the potential of the electrode for detection 613 changes due to the expansion of the ink of the ground potential projected from the nozzle, so as to determine the presence or absence of the ink ejected from the nozzle. In the ejection inspecting, when the ink is not ejected from the nozzle, the nozzle plate and the electrode for detection 613 are scattered like the condenser behavior, and when the ink is ejected from the nozzle, the ink of the ground potential and the electrode for detection 613 are scattered like the condenser behavior. In other words, the ink is ejected from the nozzle, so that the distance between electrodes of the condenser changes, the capacitance of the condenser changes, and the potential change is generated in the electrode for detection 613. Thus, as the distance d between electrodes of the condenser when the ink is not ejected from the nozzle differs largely from the distance between electrodes of the condenser when the ink is ejected from the nozzle, the potential change of the electrode for detection 613 becomes large. As a result, the maximum amplitude Vmax of the voltage signal SG (FIG. 6B) that is acquired by the detection control section 57 becomes large as well.

As described above, after the main droplet is separated, the ink column that is projected from the nozzle changes to the satellite, or returns to the pressure chamber. Thus, the distance between the nozzle surface and the position where the main droplet is separated from the ink column, that is to say, the leaving trace amount (corresponding to the distance from the tip end portion of the ink column that is projected from the nozzle to the second electrode) affects the potential change of the electrode for detection 613. In other words, as the leaving trace amount becomes long, the distance d between the electrodes of the condenser changes large, the potential change of the electrode for detection 613 becomes largely, and the maximum amplitude Vmax of the voltage signal SG becomes large. Conversely, as the leaving trace amount becomes short, the distance d between the electrodes of the condenser becomes small, the potential change of the electrode for detection 613 becomes small, and the maximum amplitude Vmax of the voltage signal SG becomes small.

Figure 8A:
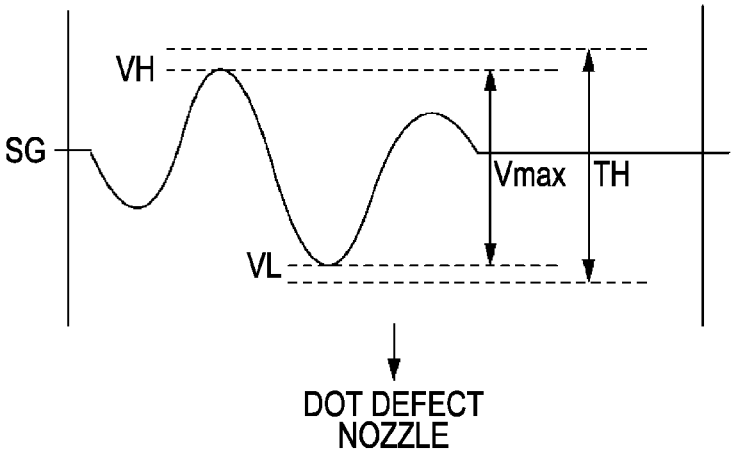
FIG. 8A is a view showing an ejection inspecting result when the ink temperature is high.

FIG. 8A is a view showing the ejection inspecting result (the voltage signal SG) when the ink temperatures is high (40° C.) in the case that the ejection inspecting is performed by the same driving waveform W regardless of the ink temperature. As shown in FIG. 7B, in the case that the ink is ejected with the same driving waveform W, the higher the ink temperature, shorter the leaving trace amount. In this way, the distance between electrodes of the condenser is hardly narrowed by the ink and the electrode for detection 613, so that the potential change of the electrode for detection 613 becomes small, and the maximum amplitude Vmax of the voltage signal SG becomes small.

For example, when the printer 1 is designed, in the case that the ink temperature is the room temperature (herein, 25° C.), the threshold value TH is determined on the basis of the maximum amplitude Vmax of the voltage signal SG which is acquired by ejecting the ink droplet from the nozzle 24 times in accordance with the driving signal COM (FIG. 6A) for inspection. In this way, in the case that the ink temperature becomes (considerably) higher than the room temperature, the leaving trace amount becomes short in the ejection inspecting, so that, as shown in FIG. 8A, the maximum amplitude Vmax of the voltage signal SG becomes smaller than the threshold value TH. As a result, the detection control section 57 determines that the ink droplet is not ejected from the nozzle, regardless of whether the high temperature ink droplet is ejected normally from the nozzle.

In other words, because when the ejection inspecting is performed with the same driving waveform W, the leaving trace amount becomes short and the maximum amplitude Vmax of the voltage signal SG becomes small, regardless of whether the ink temperature becomes much higher than the room temperature (25° C.), there is concern that a nozzle which ejects the ink droplet normally will be detected as the dot defect nozzle. As a result, the recovery operation will be performed unnecessarily, the printing time will be long, and the ink consumption amount will be increased. Thus, in the embodiment, the ejection inspecting will be performed accurately, regardless of the ink temperature.

Figure 8B:
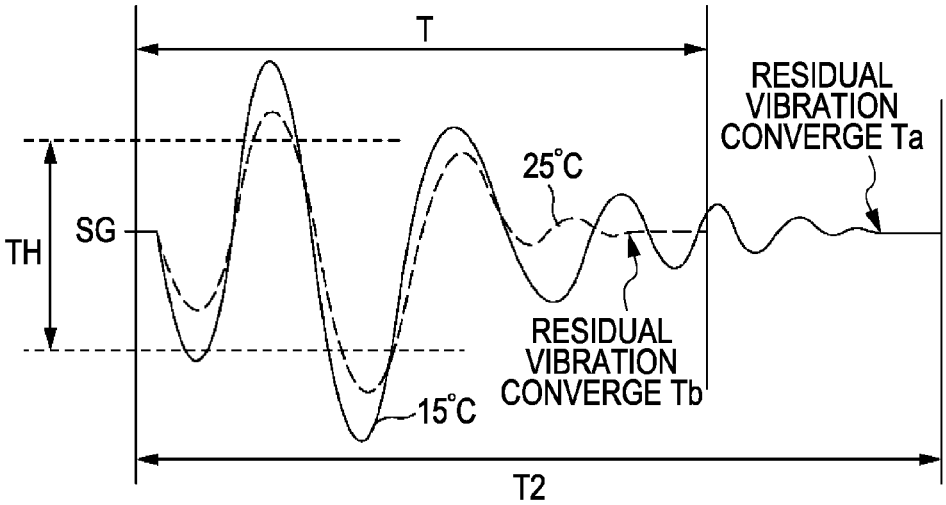
FIG. 8B is a view showing an ejection inspecting result when the ink temperature is low.

FIG. 8B is a view showing the ejection inspecting result (the voltage signal SG) when the ink temperatures is low (15° C.) in the case that the ejection inspecting is performed with the same driving waveform W regardless of the ink temperature. Also, in the drawing the voltage signal SG is present as the solid line when the ink temperature is 15° C., and the voltage signal SG is present as the dot line when the ink temperature is 25° C. As shown in FIG. 7B, in the case that the ink is ejected with the same driving waveform W, as the ink temperature becomes low, the leaving trace amount becomes long. In this way, the distance between electrodes of the condenser becomes narrowed by the ink and the electrode for detection 613, and the maximum amplitude Vmax of the voltage signal SG becomes large. By so doing, as shown in FIG. 8B, even though the threshold value TH is set according to the ink of room temperature, in the case that the ink temperature is lower than the room temperature, the maximum amplitude Vmax of the voltage signal SG becomes larger than the threshold value TH, and is determined as the normal nozzle. In other words, in the case that the ink temperature becomes considerably lower than the room temperature, as in the case that the ink temperature becomes much higher than the room temperature (FIG. 8A), there is no concern that the normal nozzle will be detected as the dot defect nozzle.

However, if the potential change of the electrode for detection 613 becomes large, and the maximum amplitude Vmax of the voltage signal SG becomes large, the residual vibration by the potential change of the voltage signal SG becomes large as well, and it takes time until the residual vibration is suppressed. Thus, as shown in FIG. 8B, in the case that the ink temperature is the room temperature (25° C.) (dot line), the residual vibration is converged at the time Tb within repeat period T, while in the case that the ink temperature is 15° C., the residual vibration is converged at the time Ta over the repeat period T.

Thus, if the inspection time T (repeat period T) of a nozzle is set to match the residual vibration of the voltage signal SG when the ink temperature is room temperature (25° C.), in the case that the ink temperature becomes low, the inspection of the next nozzle will be started in the state that the residual vibration of the voltage signal SG due to the previous nozzle inspection result is not suppressed. In other words, because the previous nozzle inspection result affects the next nozzle inspection result, the ejection inspecting will not be performed accurately.

Conversely, the inspection time of a nozzle is set to the period T2 of FIG. 8B, for example, to match the residual vibration of the voltage signal SG when the ink temperature is very low (15° C.). Thus, even the case that the ink temperature becomes low, the inspection of the next nozzle may be started after the residual vibration of the voltage signal SG occurring in the previous nozzle inspection, is suppressed. However, if the inspection time of a nozzle is set to a long time (set to T2), in the case that the ink temperature is room temperature, the time from the convergence of the residual vibration to the inspection start of the next nozzle becomes long. In other words, the inspection time will be increased, even in the case that the ink temperature is the room temperature, if the inspection time of a nozzle is set to be long match to the case that the ink temperature is low, regardless of whether a nozzle inspection time becomes short (regardless of whether it is set to the time T) in the case that the ink temperature is the room temperature, the inspection time is wasted. As a result, the whole ejection inspecting time will be long.

Also, as described above, in the case that the ink temperature is low, and the leaving trace amount is long, there is a problem that the residual vibration of the potential change that is generated in the voltage signal SG is too large; however, this is not limited to the description above. The leaving trace amount being long means that the residual vibration of the ink returned to the pressure chamber side after being separated from the main droplet, or the residual vibration of the meniscus (a free surface of the ink that is exposed from the nozzle) after the ink droplet is ejected becomes large as well. Thus, in the case that the inspection time T of a nozzle is set to the ink of the room temperature, if the ink temperature is low, the ejection inspecting of the next nozzle start, in the state in which the residual vibration of the meniscus of the previous inspection nozzle remains. In this way, the ejection inspecting will not be performed accurately. For example, even though a nozzle is a dot defect nozzle, there are fears that the nozzle may be determined as a normal nozzle, as a result of the influence of the residual vibration of the previous inspection nozzle (meniscus). Also, if the inspection time of a nozzle is set to the residual vibration of the meniscus when the ink temperature is low, the inspection time is wasted in the case that the ink temperature is the room temperature.

In other words, regardless of whether the ink temperature becomes significantly lower than the room temperature (25° C.), when the ejection inspecting is performed with the same driving waveform W, the leaving trace amount is long, and the maximum amplitude Vmax of the voltage signal SG becomes large, so that the residual vibration of the potential change that is generated at the voltage signal SG in the previous inspection of the nozzle (the previous residual vibration of the meniscus) affects the next inspection of the nozzle, and the ejection inspecting may not be performed accurately. Also, if the inspection time of a nozzle is set to be long so that converge the residual vibration converges according to the state that the ink temperature is lower than the room temperature, the inspection time may be wasted in the case that the ink temperature is the room temperature.

Also, for example, if the threshold value TH is set for each ink temperature (for example: the threshold value TH is small in the case of high temperature) or the inspection time of a nozzle is changed (for example: the inspection time is long in the case of low temperature), the control of the ejection inspecting is complicated. Thus, in the embodiment, the advantage of the invention is for the ejection inspecting to be performed easily and, at the same time, for the ejection inspecting to be performed accurately without difficulty.

Ejection Inspecting

Figure 9:
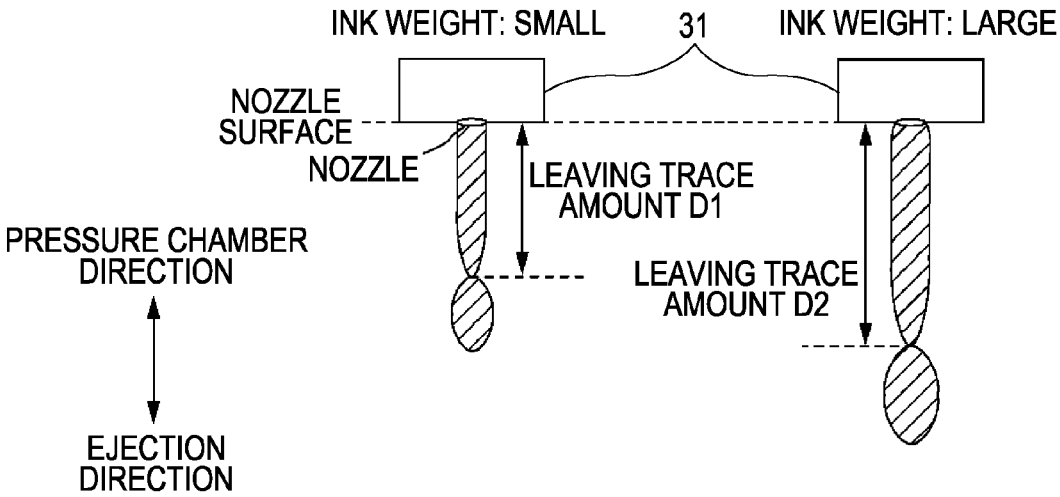
FIG. 9 is a view showing a shape that adjusts the ink weight ejected from the nozzle and adjusts the leaving trace amount from the nozzle.

FIG. 9 is a view showing a shape that adjusts the ink weight ejected from the nozzle and adjusts the leaving trace amount from the nozzle. If the ink is ejected from the nozzle with the same driving waveform W in the case that the ink temperatures are different, the leaving trace amounts are different from each other as shown in FIG. 7B, thus there are is a concern that the ejection inspecting will not be performed accurately as shown in FIG. 8A and FIG. 8B. Thus, in the embodiment, the leaving trace amount will be constant regardless of the ink temperature so as to perform the ejection inspecting accurately.

As a result, in the embodiment, the ink weight (the ink volume) that is ejected from the nozzle when the ink temperature is a first temperature is larger than the ink weight (the ink volume) that is ejected from the nozzle when the ink temperature is a second temperature that is lower than the first temperature. Also, "the ink weight that is ejected from the nozzle" is an ink weight of a main droplet that is separated from the ink column that is ejected from the nozzle by the driving waveform W. In addition, so as to make the ink weight of the main droplet large, the ink weight of the ink column projected from the nozzle becomes large as well.

For example, the temperature (for example, 40° C.) of the ink ejected from both heads 31 as shown in FIG. 9 is considerably higher than the room temperature (25° C.). Thus, if the ejection inspecting is performed using the same driving waveform W that is used in the room temperature ink, the ink column in which the leaving trace amount D1 is short as shown in the left side of FIG. 9 is ejected. In the embodiment, as shown in the right side of FIG. 9, the ink weight (the ink volume) that is ejected from the nozzle increases. Thus, in the right side of FIG. 9, the ink column is extruded from the nozzle to be thicker and longer than that of the left of FIG. 9. As a result, the leaving trace amount D2 may be long, and if the ink column is thick, the tip end portion of the ink column is difficult to separate, thus the leaving trace amount D2 may be long, even though the ink temperature is high and viscosity of the ink is low.

Conversely, the ink temperature (for example, 15° C.) ejected from both heads 31 shown in FIG. 9 is considerably lower than the room temperature. Thus, if the ejection inspecting is performed using the same driving waveform W that is used in the room temperature ink, the ink column in which the leaving trace amount D2 is long as shown in the right side of FIG. 9 is ejected. In the embodiment, as shown in the left side of FIG. 9, the ink weight (the ink volume) that is ejected from the nozzle decreases. Thus, in the left side of FIG. 9, the ink column is extruded from the nozzle to be more slender and shorter than that of the right of FIG. 9. As a result, the leaving trace amount D1 may be short, and if the ink column is slender, the tip end portion of the ink column may be separated easily, and the leaving trace amount D1 may be short, even though the ink temperature is low and the ink viscosity is high.

Also, to simplify the description, description was made in FIG. 9 regarding a correction method of the ink weight in the case that the ink temperature is high and that the ink temperature is low. However, in the case that the ink is ejected with the same driving waveform W, as shown in FIG. 7B, the higher the ink temperature, the lower the viscosity of the ink, and the ink is ejected easily, thus the ink weight (the ink volume) of the main droplet becomes large, and the lower the ink temperature, the smaller the ink weight (the ink volume). In other words, when the ejection is inspected in the case that the ink temperature is high, the ink weight (the main droplet amount) that is ejected from the nozzle is corrected to further increase the ink weight, and in the case that the ink temperature is low, the ink weight (the main droplet amount) that is ejected from the nozzle is corrected to be even smaller.

To summarize the above description, in the embodiment, to make the leaving trace amount constant when the ejection is inspected, the ink weight ejected from the nozzle is adjusted regardless of the ink temperature. Thus, the driving waveform W that is used in the ejection inspecting is corrected in accordance with the ink temperature. As a result, the ejection inspecting can perform as accurately as possible, and the residual vibration is prevented from becoming long, so that the ejection inspecting time may become as short as possible. Also, in other words, to make the leaving trace amount constant regardless of the ink temperature, the maximum amplitude Vmax of the voltage signal SG that is the result of ejection inspecting may be of the same extent, and the time for the suppression of the vibration of the residual vibration may be of the same extent as well. As a result, the inspection time of a nozzle may be constant regardless of the ink temperature, and the control of the ejection inspecting is performed easily.

Also, in the driving signal COM (FIG. 6A) for the ejection inspecting in the embodiment, the driving waveforms (24 driving waveforms W) for a nozzle are generated repeatedly for each repeat period T.

Correction of Waveform W for the Ejection Inspecting

Figure 10A:
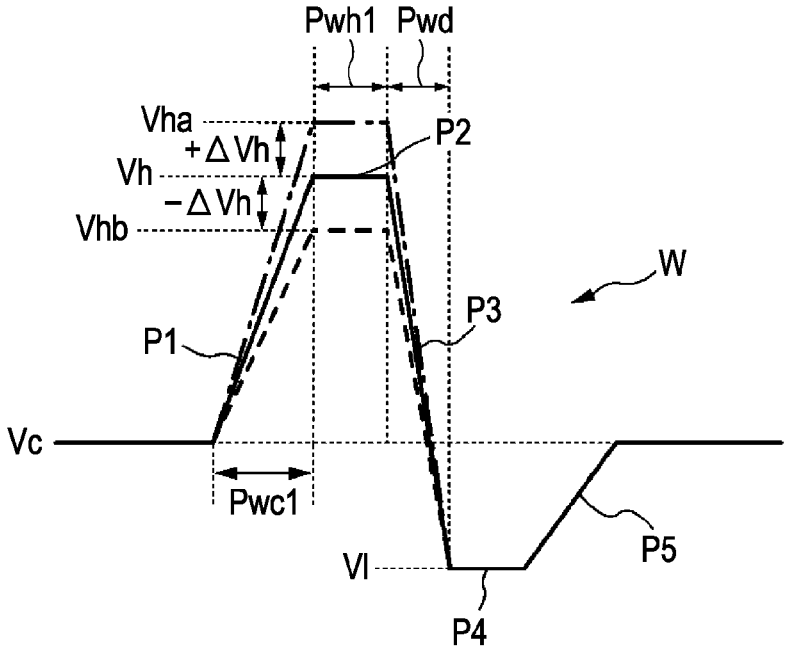
FIG. 10A is a view showing a shape that corrects the driving waveform in accordance with the ink temperature.
Figure 10B:
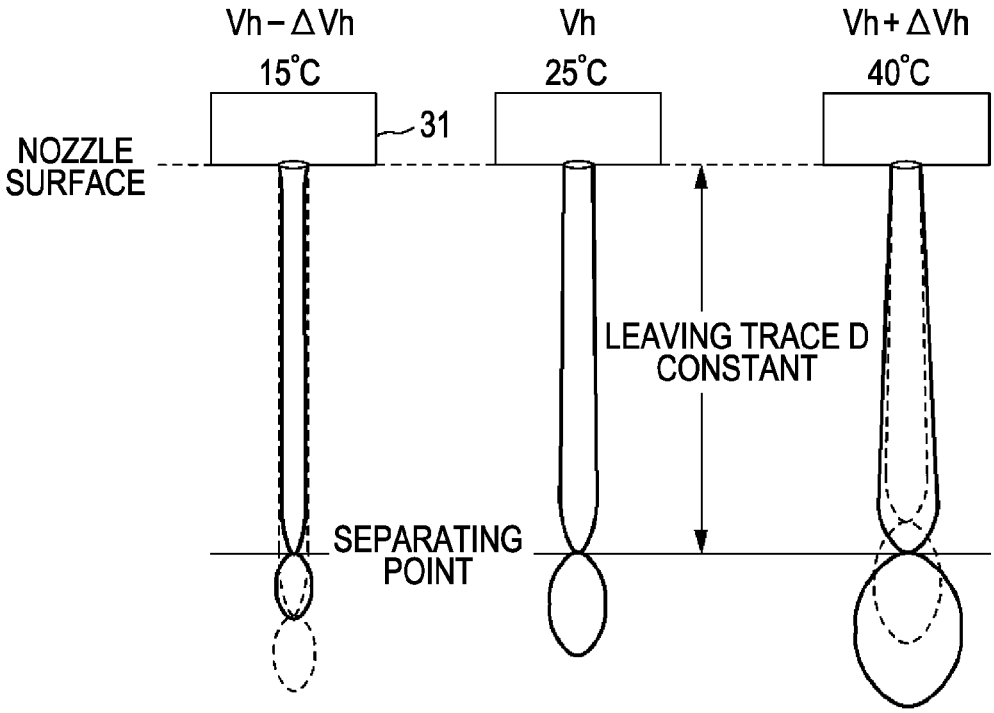
FIG. 10B is a view showing a leaving trace in the case that the driving waveforms are corrected.

FIG. 10A is a view showing a shape that corrects a driving waveform W in accordance with the ink temperature, FIG. 10B is a view showing leaving traces in the case that the driving waveform W is corrected, and FIG. 11 is a table showing correction value corresponding to the ink temperatures and correction amount of the maximum potential Vh. In the ejection inspecting of the embodiment, to make the leaving trace amount constant regardless of the ink temperature, the highest potential Vh of the parameters that constitute the driving waveform W is corrected. Also, the controller 80 acquires the ink temperature, and generates the driving waveform W (the driving signal COM) that is the highest potential Vh, in the driving signal generating circuit 40 in accordance with the ink temperature.

Also, because the ink within the head 31 is affected by the surrounding temperature of the head 31, in the embodiment, as shown in FIG. 2A, the temperature (the environmental temperature of the head) that is detected by the temperature sensor 71 (corresponding to the sensor) provided on the intermediate substrate 35 of the head 31 is "the ink temperature Ti". In other words, the temperature sensor 71 is the sensor that outputs the signal in accordance with the temperature change of the ink (liquid). Thus, in the design process and the like, even when the correction amount (ΔVh) of the highest potential (Vh) is determined in accordance with the ink temperature, the correction amount may be determined on the basis of the output result of the temperature sensor 71 on the intermediate substrate of the head 31. However, without being limited to the above description, the driving waveform W may be corrected by the measurement result of the ink temperature within the head 31 substantially, and the driving waveform W may be corrected by the measurement result of the ink temperature within the ink cartridge as the ink temperature. In other words, the driving waveform W may be corrected by the temperature in accordance with the ink temperature, regardless of the actual ink temperature.

Also, the driving waveform W that is used when the ink temperature Ti is the room temperature (25° C.) or temperature near thereof is the reference driving waveform Ws. In FIG. 10A, the reference driving waveform Ws is shown as a solid line, the driving waveform W that is used when the ink temperature Ti is higher than the room temperature is shown as a dot dash line, and the driving waveform W that is used when the ink temperature Ti is lower than the room temperature is shown as a dot line. Also, in FIG. 10B, the ink that is ejected from the nozzle with the reference driving waveform Ws is shown as a dot line, and the ink that is ejected from the nozzle with the driving waveform W that is corrected by the highest potential Vh in accordance with the ink temperature Ti is shown as a thick line.

In the case that the ink temperature Ti is higher than the room temperature, and the leaving trace amount becomes short, as shown in FIG. 10A, to increase the ink weight ejected from the nozzle, the controller 80 corrects the highest potential Vha (Vh+ΔVh) to be higher than the highest potential Vh of the reference driving waveform Ws. Also, the parameter of the driving waveform W is not corrected except the highest potential Vh, and the expansion time Pwc1 of the first expansion component P1, the hold time Pwh1 of the first hold component P2, and the contraction time Pwd of the contraction component P3 are not corrected either. The highest potential of the driving waveform W is corrected to the higher potential Vha, so that the pressure chamber (331 in FIG. 2) may be expanded to be larger than the reference driving waveform Ws. As a result, because the contraction rate of the pressure chamber (the volume deference of the pressure chamber between in expansion and in contraction) may be large, the ink weight that is ejected from the nozzle (the pressure chamber) may be further increased. Also, the contraction time Pwd is not changed, so that the contraction velocity of the pressure chamber is fast, and the velocity of the ink that is ejected from the nozzle is fast as well.

Conversely, in the case that the ink temperature Ti is lower than the room temperature, and the leaving trace amount becomes long, so as to decrease the ink weight that is ejected from the nozzle, the highest potential Vhb (Vh−ΔVh) is corrected to be lower than the highest potential Vh of the reference driving waveform Ws. Thus, the pressure chamber expands to be smaller than the reference driving waveform Ws, and the contraction rate of the pressure chamber becomes small. As a result, the ink weight that is ejected from the nozzle (the pressure chamber) may be small. Also, because the contraction time Pwd is not changed, the contraction velocity of the pressure chamber is slow, and the velocity of the ink that is ejected from the nozzle may be slow.

Thus, in the case that the ink temperature Ti is higher than the room temperature, the highest potential Vh is corrected to the high potential, and in the case that the ink temperature Ti is lower than the room temperature, the highest potential Vh is corrected to the low potential. As a result, as shown in FIG. 10B, in the case that the ink temperature Ti is high (40° C.), the ink weight that is ejected from the nozzle is increased and the leaving trace amount may be long, compared to the case that the reference driving waveform Ws is used. Meanwhile, in the case that the ink temperature is low (15° C.), the ink weight that is ejected from the nozzle is decreased, and the leaving trace amount may be short compared to the case in which the reference driving waveform Ws is used. Thus, the leaving trace amount D will be constant regardless of the ink temperature.

Because the leaving trace amount D is constant (that is, set to the leaving trace amount when the ink temperature is the room temperature), it can perform suppression so that the highest amplitude Vmax of the voltage signal SG becomes smaller than the threshold value TH (FIG. 8A) regardless of ejecting the ink from the nozzle, or the residual vibration that is generated on the voltage signal SG does not eliminate the vibration within the inspection time of a nozzle (FIG. 8B). As a result, the ejection inspecting is performed accurately, and it can prevent that the inspection time of a nozzle from being wastefully delayed.

Also, in the printer 1 of the embodiment, the correction value table in FIG. 11 is stored in the memory 80*c*. In the correction value table, the ink temperature Ti (acquired temperature) is divided in a plurality of temperature ranges and the correction amount ΔVh of the highest potential Vh corresponds to each temperature range. Here, the correction amount ΔVh is set every 10° C. Specifically, in the case that the ink temperature Ti is not less than 40° C., the highest potential is corrected to be higher than the highest potential Vh of the reference driving waveform Ws by "ΔVh1", in the case that the ink temperature is not less than 30° C. and below 40° C., the highest potential is corrected to be higher than the reference highest potential Vh by "ΔVh2", in the case that the ink temperature Ti is not less than 10° C. and below 20° C., the highest potential is corrected to be lower than the reference highest potential Vh by "ΔVh3", and in the case that the ink temperature is below 10° C., the highest potential is corrected to be lower than the reference highest potential Vh by "ΔVh4" (+ΔVh1>+ΔVh2, −ΔVh3>−ΔVh4).

Thus, in the case that the ink temperature Ti is not less than 20° C. and below 30° C. including the room temperature (25° C.) shown in FIG. 11, the reference highest potential Vh is not corrected, in other words, the correction amount ΔVh is zero. When the ink temperature is within the temperature range including the room temperature, the leaving trace amount D, that is to say, the potential change (the maximum amplitude Vmax) in the voltage signal SG (the ejection inspecting result) is not too large and is not too small. In other words, the potential change of the voltage signal SG is too large, so that it can be prevented that the residual vibration becomes large and the inspection time of a nozzle becomes long, while the potential change of the voltage signal SG is too small, so that it can be prevented that the normal nozzle is detected as the dot defect nozzle in error. Also, it is assumed that the ink temperature Ti that is detected by the sensor 71 of the head 31 has a higher chance of being within the temperature range including the room temperature. Also, in the case that the ink temperature Ti is within the temperature range including the room temperature, the driving waveform W is not to correct, so that the number of the corrections will be decreased, and the control of the ejection inspecting is performed easily. Thus, in the embodiment, the leaving trace amount D is arranged when the ink temperature Ti is in the room temperature (25° C.) or temperature near thereto.

To summarize the above description, first of all, when the ejection inspecting starts, the controller 80 of the printer 1 acquires the ink temperature Ti from the temperature sensor 71 that is provided on the head 31. Next, the controller 80 refers to the correction value table in FIG. 11 and acquires the correction amount ΔVh of the highest potential Vh corresponding to the acquired ink temperature Ti. Thus, the controller 80 generates the driving waveform W that is the highest potential in the driving signal generation circuit 40 in accordance with the ink temperature Ti. Thus, the driving signal COM (the driving waveform W) that is generated in the driving signal generation circuit 40 is applied per each nozzle in sequence to the piezoelectric element that corresponds to the inspection object nozzle of the head 31 (FIG. 3B) which is positioned on the home position, and the presence or absence of the ejection from the nozzle is inspected. The controller 80 acquires the ejection inspecting result (the presence or not of the dot defect nozzle) from the detection control section 57 (the dot defect detection section 50). In the case that the dot defect nozzle is detected, the controller 80 performs the recovery operation, and in the case that the dot defect nozzle is not detected, the printing starts or operates continuously. After the recovery operation, the ejection inspecting is performed again, so that it may be confirmed whether the dot defect nozzle has been restored to the normal nozzle.

Modified Example of the Driving Waveform Correction

Figure 12A:
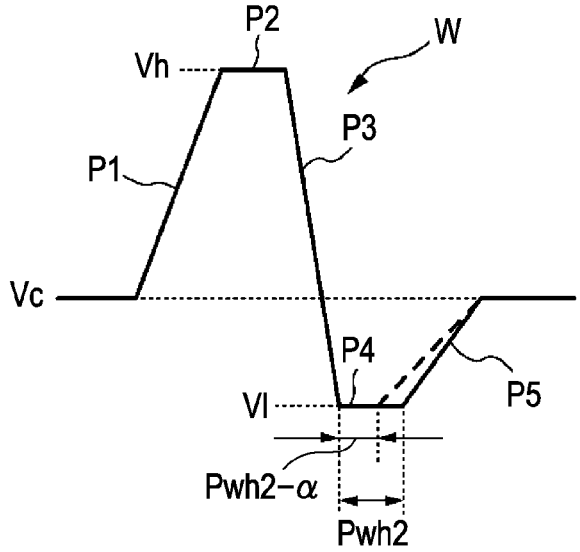
FIG. 12A is a view showing a shape to correct the other parameter of the driving waveform so as to make the leaving trace amount short.
Figure 12B:
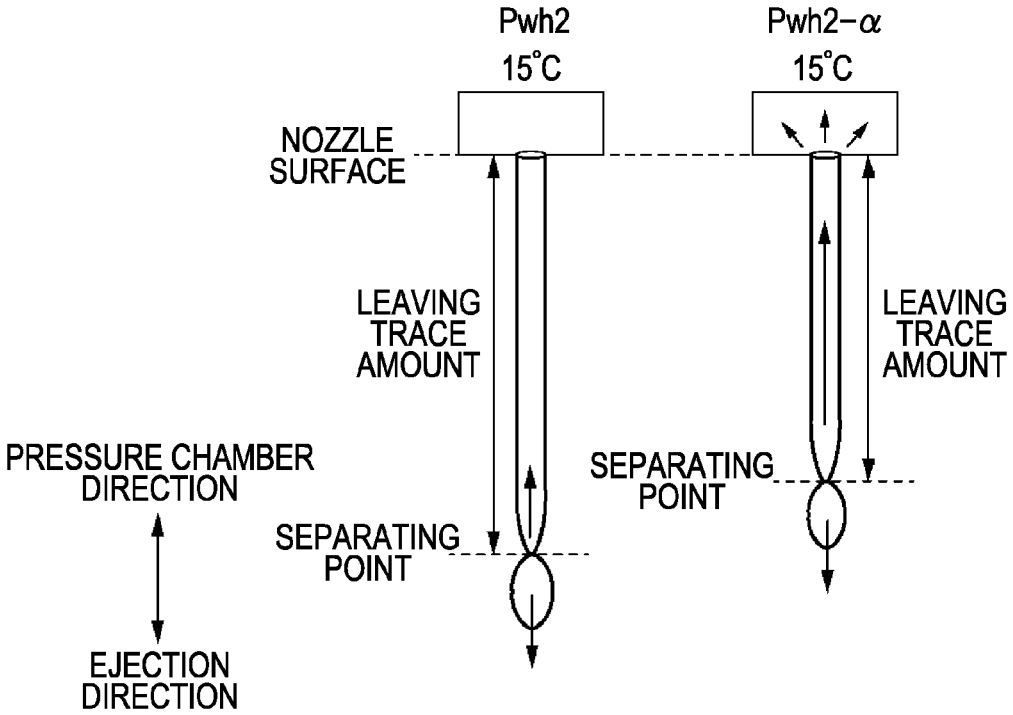
FIG. 12B is a view showing a leaving trace in the case that the driving waveform is corrected.

FIG. 12A is a view showing a shape to correct the other parameter (PWh2) of the driving waveform W so as shorten leaving trace amount in the case that the ink temperature Ti is a low temperature. FIG. 12B is a view showing a leaving trace in the case that the driving waveform is corrected. As described above, to make the leaving trace amount constant by correcting the ink weight ejected from the nozzle, the highest potential Vh of the driving waveform W is corrected; however, it is not limited to this. As one of the parameters that constitute the driving waveform W, the ink weight (the main droplet amount) that is ejected from the nozzle can be adjusted and, as a result, the parameter that can adjust the leaving trace amount, may be corrected in accordance with the ink temperature Ti.

For example, as shown in FIGS. 12A and 12B, to shorten the leaving trace amount, "the second hold time PWh2" of the second hold component P4 may be corrected. In the case that the ink temperature Ti is lower than the room temperature (for example, 15° C.), as shown in FIG. 7B, the leaving trace amount becomes too long. Thus, in the case that the ink temperature Ti is low, the second hold time PWh2 may be corrected to be short. When the driving waveform W in FIG. 12A is applied to the piezoelectric element, the ink column from the nozzle is projected with the contraction component P3. Thus, the ink column is expanded so that the ink droplet is separated in the second hold time PWh2, or when the pressure chamber (331 in FIG. 2) is expanded with the second expansion component P5 and the main droplet and the ink column are separated from each other. Thus, as shown in the right side of FIG. 12A, the second hold time PWh2 is corrected to be shorter (PWh2+α), so that a force toward the pressure chamber moves on the ink column due to the second expansion component P5, before the ink column projected with the contraction component P3 is extended sufficiently. As a result, the main droplet is separated (the main droplet amount becomes small as well), and the leaving trace amount may be short in the case that the ink weight that is ejected from the nozzle becomes small. Thus, the second hold time Pwh2 is corrected in accordance with the ink temperature Ti, so that even in the case that the ink temperature Ti is low, the leaving trace amount may be corrected in the same manner as in the case that the ink temperature is room temperature. Also, there is no limitation that only one parameter of the driving waveform W is corrected, for example, in the case that the ink temperature Ti is low, two parameters, the highest potential Vh and the second hold time PWh2 may be corrected.

Correction of the Driving Waveform W in Printing and in Ejection Inspecting

Figure 13A:
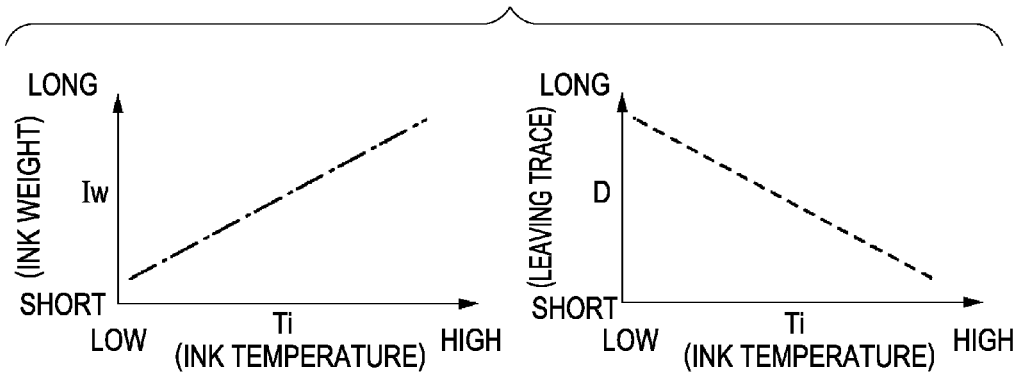
FIG. 13A is a view showing the difference between the ink weight and the leaving trace due to the ink temperature.
Figure 13B:
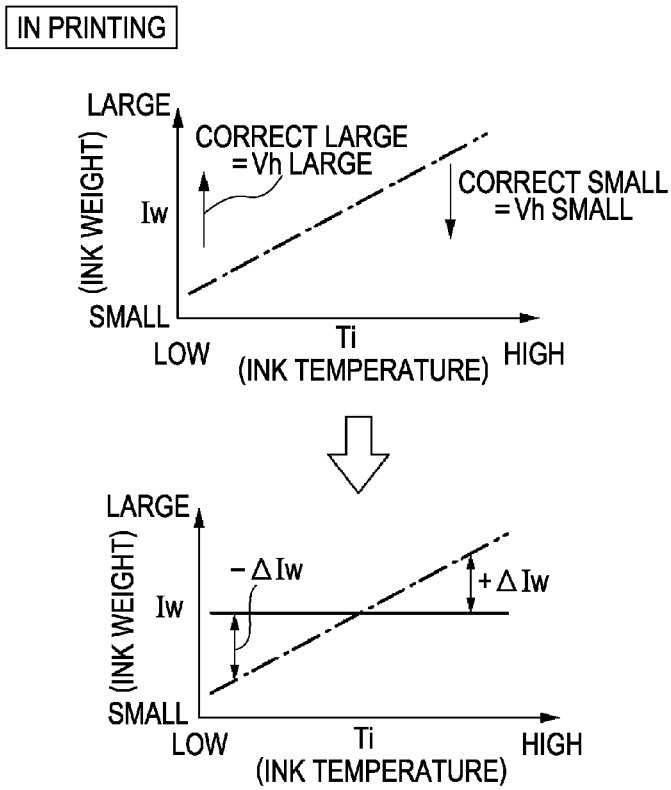
FIG. 13B is a view illustrating the correction of the driving waveform in printing.
Figure 13C:
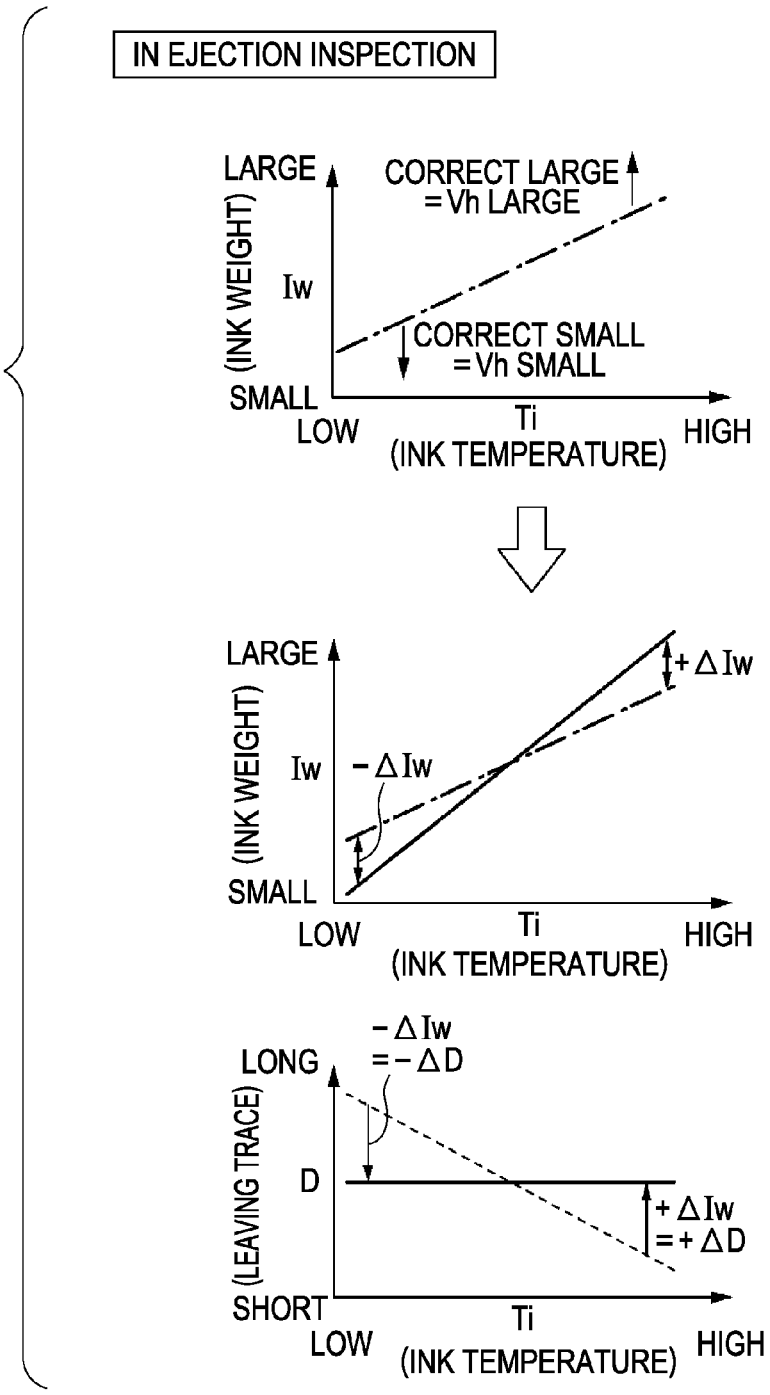
FIG. 13C is a view illustrating the correction of the driving waveform in inspecting the ejection.

FIG. 13A is a view showing the difference between an ink weight and a leaving trace due to the ink temperature, FIG. 13B is a view illustrating a correction of a driving waveform in printing, and FIG. 13C is a view illustrating a correction of a driving waveform W in inspecting the ejection. As shown in FIG. 13A, because the ink temperature is high, the viscosity of the ink becomes low, the ink is ejected easily from the nozzle, the ink weight increases, and the leaving trace amount becomes short. Conversely, because the ink temperature is low, the viscosity of the ink becomes high, the ink is hardly ejected from the nozzle, the ink weight decreases, and the leaving trace amount becomes long.

As shown in FIG. 13B, it is preferable that the dot diameter (the ink weight and the main droplet amount ejected from the nozzle) is constant if possible so as to print the image with high quality during printing regardless of the effect of the ink temperature. Thus, in printing, in the case that the ink temperature is high, the highest potential Vh of the driving waveform is corrected to be low, and the ink weight that is ejected from the nozzle decreases, conversely, in the case that the ink temperature is low, the highest potential Vh of the driving waveform is corrected to be high, and the ink weight that is ejected from the nozzle increases. Also, during printing the driving signal COM may be made different from the driving signal COM (FIG. 6A).

Conversely, as shown in FIG. 13C, during ejection inspecting, it is preferable that the leaving trace amount is constant being affected by the ink temperature. Thus, in ejection inspecting, in the case that the ink temperature is high, the ink weight that is ejected from the nozzle increases easily and the highest potential Vh of the driving waveform W is corrected to be high to further increase the ink weight. As a result, the leaving trace amount may be long. Conversely, in the case that the ink temperature is low, the ink weight that is ejected from the nozzle decreases easily and the highest potential Vh of the driving waveform W is corrected to be low to further decrease the ink weight. As a result, the leaving trace amount may be short.

In other words, in the printer 1 of the embodiment, the correction method of the driving waveform W is performed in reverse in printing and in ejection inspecting. Thus, the ink weight that is ejected from the nozzle may be constant without being affected by the ink temperature in printing, and conversely, the leaving trace amount may be constant without being affected by the ink temperature in the ejection inspecting, and the ejection inspecting time may be short, while the ejection inspecting is performed accurately.

The Other Embodiment

Each embodiment described above mainly describes the printing system having the ink jet type printer; however, an ejection inspecting method and the like are also included. Also, the invention is not limited to the above embodiments which are provided to facilitate understanding of the invention. Thus although the invention has been described in the context of a specific embodiment thereof it will be appreciated by those having skill in the art that changes and modifications may be made thereto without departing from the scope and spirit of the invention, and further the invention includes the equivalents thereof as well. Especially, the invention includes the embodiments described below.

Dot Defect Detection Section 50

In the above described embodiments, the abnormality of the electrode for detection 613 is detected on the basis of the change of the electrical state caused by the current If for the ejection inspecting without providing a voltage division circuit on the dot defect detection section 50; however, the above description is not limited, and it may be that the power supply voltage is divided by the voltage division circuit, and the abnormality of the electrode for detection 613 is detected on the basis of the detected voltage.

Also, in the embodiments described above, the electrode for detection 613 has a higher potential than the nozzle surface, and the potential change of the electrode for detection 613 due to the ejection of the ink droplet by the condenser for detection 54 is extracted; however, this is not limited to the above description. For example, the high voltage power supply unit may be connected to the nozzle plate 33*b* so that the nozzle plate 33*b* has a high potential, the electrode for detection 613 may be connected to the ground potential so that the electrode for detection 613 is the ground potential, and the dot defect nozzle is detected by the potential change of the nozzle plate 33*b* in which the ink is ejected, or the dot defect nozzle may be detected by the potential change of the electrode for detection 613. Also, the dot defect nozzle may be detected by the potential change of the nozzle plate 33*b* in which the ink is ejected in the electrode for detection 613 of the high potential and the nozzle plate 33*b* of the ground potential.

In the embodiments described above, the nozzle plate is the first potential (the ground potential), so that the ink that is ejected from the nozzle becomes the ground potential; however, the above description is not limiting. If the ink that is ejected from the nozzle is constituted to be the first potential (the ground potential), the nozzle plate does not need to be the electrode. For example, the conductive member is provided on the wall surface of the ink flow path or the pressure chamber 331 and the like, to be conductive with the ink within the nozzle, and the conductive member may be the ground potential. Also, the ink is not limited to the ground potential as long as the necessary potential difference for the detection is present between the electrodes for detection 613.

Printer

In the above described embodiments, examples have been given in which, in the printer 1, the image forming operation, in which the ink droplet is ejected while the head 31 moves along the transporting direction, and the transport operation, in which the head 31 and the medium moves relative to each other in the transporting direction that crosses the moving direction are performed alternately; however, the above description is not limiting. For example, the printer may be a line head printer that forms the image by arranging the heads (nozzles) in a row in the paper width direction crossing the medium transporting direction and ejecting the ink droplet to the medium that is transported below the head.

Liquid Ejecting Apparatus

In the above described embodiments, the embodiments have provided an example of an ink jet printer as the liquid ejecting apparatus; however, this description is not limiting. The liquid ejecting apparatus is applicable not only to the printer (the printing apparatus) but also various industrial apparatus. For example, the invention may applied to a printing apparatus for attaching a pattern to a cloth, a color filter manufacturing apparatus, a display manufacturing apparatus such as an organic EL display, and a DNA chip manufacturing apparatus that manufactures a DNA chip by coating a DNA fused solution to the chip.

Also, the liquid ejection method may be a piezoelectric method in which the voltage is applied to the driving element (the piezoelectric element), so that the liquid is ejected in accordance with to the expansion or contraction of the ink chamber, and may be a thermal method in which bubbles are generated within the nozzle by using a heat generation element, and the liquid is ejected by the bubbles.

While the invention has been described in conjunction with several specific embodiments, it is evident to those skilled in the art that many further alternatives, modifications and variations will be apparent in light of the foregoing description. Thus, the invention described herein is intended to embrace all such alternatives, modifications, applications and variations as may fall within the spirit and scope of the appended claims.

What is claimed is:

1. A liquid ejecting apparatus including:

(A) a nozzle that ejects a liquid;

(B) a sensor that outputs a signal in accordance with a temperature change of the liquid;

(C) a driving signal generation section that generates a driving signal for ejecting the liquid from the nozzle;

(D) an inspection section that ejects the liquid of a first electrical potential by the driving signal toward a second electrode of a second electrical potential which is different from the first electrical potential by making the liquid which is ejected from the nozzle to become the first electrical potential by a first electrode, and inspecting whether the liquid ejection from the nozzle is present or not on the basis of a capacitance change between the first electrode and the second electrode; and (E) a controller that corrects the driving signal that is generated at the driving signal generation section in accordance with the liquid temperature on the basis of an output result of the sensor when the ejection is inspected, and that makes a liquid weight of a first temperature more than a liquid weight of a second temperature, in which the liquid weight of the first temperature is ejected from the nozzle when the liquid temperature is the first temperature on the basis of an output result of the sensor and the liquid weight of the second temperature is ejected from the nozzle when the liquid temperature is the second temperature that is lower than the first temperature on the basis of the output result of the sensor.

2. The liquid ejecting apparatus according to claim 1, wherein the inspection section inspects whether the liquid ejection from the nozzle is present or not, on the basis of the capacitance change that is changed in accordance with a distance from a tip end portion of the liquid column to the second electrode by the driving signal, and the liquid column is projected from the nozzle.

3. The liquid ejecting apparatus according to claim 1, wherein the apparatus classifies the liquid temperature that is detected by the sensor into a plurality of temperature ranges, and a correction amount is set with respect to the driving signal in each temperature range, and the controller does not correct the driving signal that is generated at the driving signal generation section, when the liquid temperature belongs to the temperature range including room temperature, on the basis of the output result of the sensor.

4. The liquid ejecting apparatus according to claim 1, wherein the driving signal repeatedly generates a driving waveform for ejecting the liquid from the nozzle, and a gap is constant between the driving waveform inspecting whether the liquid ejection from one of the nozzles is present or not and the driving waveform inspecting whether the liquid ejection from the next nozzle is present or not.

5. The liquid ejecting apparatus according to claim 1, wherein the driving waveform that is generated at the driving signal is applied so as to drive a driving element, and a pressure chamber that communicates with the nozzle corresponding to the driving element is expanded or contracted so as to eject the liquid from the nozzle, the driving waveform has an expansion component and a contraction component, in which the expansion component expands the pressure chamber due to the electrical potential change from a predetermined electrical potential to the first electrical potential, and the contraction component contracts the expanded pressure chamber due to the electrical potential change from the first electrical potential to the second electrical potential, and the controller corrects the first electrical potential of the driving waveform that is generated at the driving signal generation section in accordance with the liquid temperature on the basis of the output result of the sensor.

6. An ejection inspecting method that ejects the liquid of a first electrical potential by a driving signal toward a second electrode of a second electrical potential which is different from the first electrical potential by making the liquid that is ejected from a nozzle to become the first electrical potential by a first electrode, and inspecting whether the liquid ejection from the nozzle is present or not on the basis of a capacitance change between the first electrode and the second electrode, the method comprising:

correcting the driving signal corresponding to the liquid temperature on the basis of an output result of a sensor that outputs a signal corresponding to the change of the liquid temperature; and making a liquid weight of a first temperature more than a liquid weight of a second temperature, the liquid weight of the first temperature is ejected from the nozzle when the liquid temperature is the first temperature on the basis of an output result of the sensor and the liquid weight of the second temperature is ejected from the nozzle when the liquid temperature is the second temperature that is lower than the first temperature on the basis of the output result of the sensor.

* * * * *